US010439338B2

(12) United States Patent
Motoichi

(10) Patent No.: US 10,439,338 B2
(45) Date of Patent: Oct. 8, 2019

(54) CABLE WITH PLUG, CONTROL CIRCUIT AND SUBSTRATE

(71) Applicant: Yoshihiro Motoichi, Tokyo (JP)

(72) Inventor: Yoshihiro Motoichi, Tokyo (JP)

(73) Assignee: MITSUMI ELECTRIC CO., LTD., Tokyo (JP)

( * ) Notice: Subject to any disclaimer, the term of this patent is extended or adjusted under 35 U.S.C. 154(b) by 768 days.

(21) Appl. No.: 14/804,525

(22) Filed: Jul. 21, 2015

(65) Prior Publication Data

US 2016/0056588 A1 Feb. 25, 2016

(30) Foreign Application Priority Data

Aug. 22, 2014 (JP) ..... 2014-169577

(51) Int. Cl.
*H01R 13/713* (2006.01)
*H01R 13/66* (2006.01)
*H01R 24/62* (2011.01)

(52) U.S. Cl.
CPC ..... *H01R 13/7137* (2013.01); *H01R 13/6683* (2013.01); *H01R 24/62* (2013.01)

(58) Field of Classification Search
CPC ..... H01R 13/70; H01R 13/6683
See application file for complete search history.

(56) References Cited

U.S. PATENT DOCUMENTS

RE34,179 E * 2/1993 Eccleston ..... H01L 25/167 257/467
6,211,649 B1 4/2001 Matsuda
6,678,829 B1 1/2004 Teggatz et al.
2010/0162054 A1* 6/2010 Asuncion ..... G06F 13/4068 714/56
2011/0104940 A1 5/2011 Rabu et al.
2012/0049931 A1* 3/2012 Yamada ..... H03K 17/063 327/434

(Continued)

FOREIGN PATENT DOCUMENTS

CN 101471462 7/2009
JP H08-280140 10/1996

(Continued)

OTHER PUBLICATIONS

Japanese Office Action for 2014-169577 dated Oct. 3, 2017.
Japanese Office Action for 2014-169577 dated Jun. 27, 2017.
Chinese Office Action for 201510519891.6 dated Jul. 31, 2018.

*Primary Examiner* — Daniel J Cavallari
(74) *Attorney, Agent, or Firm* — IPUSA, PLLC

(57) ABSTRACT

A plug with a cable includes a plug and a cable. The plug is connected to a receptacle to which a secondary cell is connected. The plug includes a hosing and a substrate therein. The cable includes a power supply line and a grounding line. The cable has one end connected to the plug and the other end connected to a power supply unit. A switch is mounted on the substrate and provided in series in a power supply interconnection connected to the power supply line. A temperature sensor is mounted on the substrate and disposed near a power supply terminal or a grounding terminal of the plug. A control circuit is mounted on the substrate and configured to interrupt the power supply interconnection by turning off the switch when a temperature detected by the temperature sensor exceeds a predetermined value.

20 Claims, 14 Drawing Sheets

(56) References Cited

U.S. PATENT DOCUMENTS

| | | | | |
|---|---|---|---|---|
| 2014/0156879 | A1* | 6/2014 | Wong | G06F 11/3027 710/19 |
| 2015/0022141 | A1 | 1/2015 | Oku | |
| 2015/0288110 | A1* | 10/2015 | Taniguchi | H01R 13/46 439/620.22 |
| 2017/0201050 | A1* | 7/2017 | Akita | H01B 11/00 |

FOREIGN PATENT DOCUMENTS

| | | |
|---|---|---|
| JP | H09-266640 | 10/1997 |
| JP | 2000-339067 | 12/2000 |
| JP | 2006-171860 | 6/2006 |
| JP | 5447723 | 3/2014 |

* cited by examiner

CABLE WITH PLUG, CONTROL CIRCUIT AND SUBSTRATE

CROSS-REFERENCE TO RELATED APPLICATIONS

This patent application is based upon and claims the benefit of priority of Japanese Patent Application No. 2014-169577, filed on Aug. 22, 2014, the entire contents of which are incorporated herein by reference.

BACKGROUND OF THE INVENTION

1. Field of the Invention

The present invention relates to a cable with a plug, a control circuit and a substrate.

2. Description of the Related Art

In general, when charging a secondary battery installed in an electronic device (which is hereinafter referred to as a "secondary-cell-side electronic device"), the secondary battery is charged by connecting the secondary-cell-side electronic device to an electronic device that becomes a power source (which is hereinafter referred to as a "power-source-side electronic device") through a feed cable. On this occasion, a plug provided at an end of the feed cable is connected to the secondary-cell-side electronic device, and a plug provided at the other end is connected to the power-source-side electronic device.

When performing this connection, for example, if the plugs are inserted in an opposite manner, the feed cable is liable to produce heat. Conventionally, as disclosed in Japanese Laid-Open Patent Application Publication No. 2006-171860, there has been a protective device for preventing the heat generation of the feed cable configured to provide a fuse in an electronic device and to interrupt the power feeding by causing the fuse to be cut due to the produced heat.

Moreover, Japanese Laid-Open Patent Application Publication No. 2000-339067 discloses a protective device installed in an IC (Integrated Circuit) that controls charging and is provided in the middle of a feed cable, which is configured to interrupt the power feeding when a temperature of the feed cable is equal to or higher than a predetermined temperature.

However, when using the fuse, once the fuse is cut due to an abnormal temperature, the electronic device cannot be used until the fuse is replaced by new one. In addition, because installing the fuse in the feed cable is difficult, the heat generation of the feed cable cannot be directly detected.

In the configuration of detecting the abnormal temperature by using the protective device installed in the middle of the feed cable, the generated heat is measured by a temperature sensor installed in the middle of the feed cable, and the power feeding is interrupted based on the measured heat. Accordingly, when an abnormal temperature is generated at a location other than the location including the temperature sensor of the feed cable, the abnormal temperature cannot be detected promptly.

SUMMARY OF THE INVENTION

Accordingly, one of the illustrative aims of embodiments of the present invention is to provide a cable with a plug, a control circuit and a substrate that can detect an abnormal temperature promptly and reliably and do not need troublesome work such as fuse replacement.

According to one embodiment of the present invention, there is provided an A plug with a cable including a plug connected to a receptacle to which a secondary cell is connected. The plug includes a hosing and a substrate provided in the housing. The plug with the cable further includes a cable including a power supply line and a grounding line. The cable has one end connected to the plug and the other end connected to a power supply unit. A switch is mounted on the substrate provided in the housing of the plug and provided in series in a power supply interconnection connected to the power supply line. A temperature sensor is mounted on the substrate and disposed in the vicinity of a power supply terminal of the plug or a grounding terminal of the plug. A control circuit is mounted on the substrate and configured to interrupt the power supply interconnection by turning off the switch upon determining that a value related to a temperature detected by the temperature sensor exceeds a predetermined value.

According to another embodiment of the present invention, there is provided a control circuit used with a cable with a plug. The cable with the plug includes a plug connected to a receptacle to which a secondary cell is connected. The plug includes a hosing and a substrate provided in the housing. The cable with the plug further includes a cable including a power supply line and a grounding line. The cable has one end connected to the plug and the other end connected to a power supply unit. The control circuit includes a switch mounted on the substrate provided in the housing of the plug and provided in series in a power supply interconnection connected to the power supply line. The control circuit also includes a temperature sensor mounted on the substrate and disposed in the vicinity of a power supply terminal of the plug or a grounding terminal of the plug. The control circuit further includes a control integrated circuit mounted on the substrate and configured to interrupt the power supply interconnection by turning off the switch upon determining that a value related to a temperature detected by the temperature sensor exceeds a predetermined value.

According to another embodiment of the present invention, there is provided a substrate provided in a housing of a cable with a plug. The cable with the plug includes a plug connected to a receptacle to which a secondary cell is connected. The cable with the plug further includes a cable including a power supply line and a grounding line. The cable has one end connected to the plug and the other end connected to a power supply unit. The substrate includes a switch provided in series in a power supply interconnection connected to the power supply line, and a temperature sensor disposed in the vicinity of a power supply terminal of the plug or a grounding terminal of the plug. The substrate further includes a control circuit configured to interrupt the power supply interconnection by turning off the switch upon determining that a value related to a temperature detected by the temperature sensor exceeds a predetermined value.

Additional objects and advantages of the embodiments are set forth in part in the description which follows, and in part will become obvious from the description, or may be learned by practice of the invention. The objects and advantages of the invention will be realized and attained by means of the elements and combinations particularly pointed out in the appended claims. It is to be understood that both the foregoing general description and the following detailed description are exemplary and explanatory and are not restrictive of the invention as claimed.

DETAILED DESCRIPTION OF THE PREFERRED EMBODIMENTS

Figure 1A:
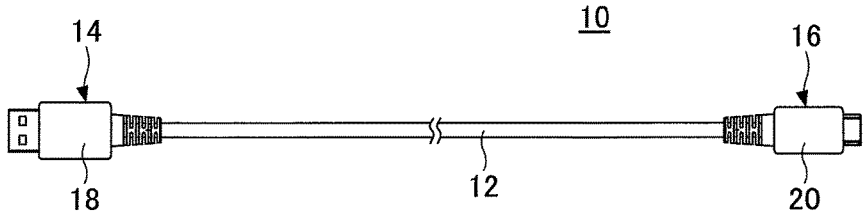
FIGS. 1A and 1B are outside drawings of a USB cable according to an embodiment of the present invention.

A description is given below of not restrictive but illustrative embodiments of the present invention, with reference to accompanying drawings.

Note that elements having substantially the same configuration may be given the same reference numerals and overlapping descriptions thereof may be omitted. Moreover, the drawings are not intended to indicate a relative ratio between members or parts as long as they are not specified. Accordingly, a specific dimension thereof can be determined by a person skilled in the art with reference to the following embodiments that are not restrictive.

Furthermore, the embodiments described below are not intended to limit the present invention but to illustrate the present invention, and all features described in the embodiments and the combination thereof are not necessarily essential part of the present invention.

Figure 1B:
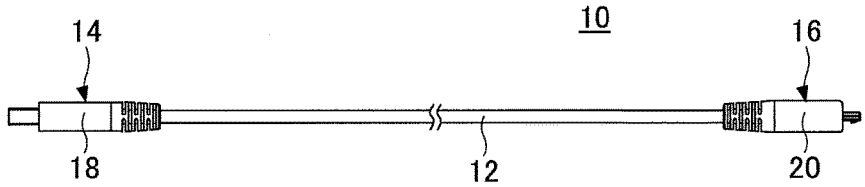
Figure 2:
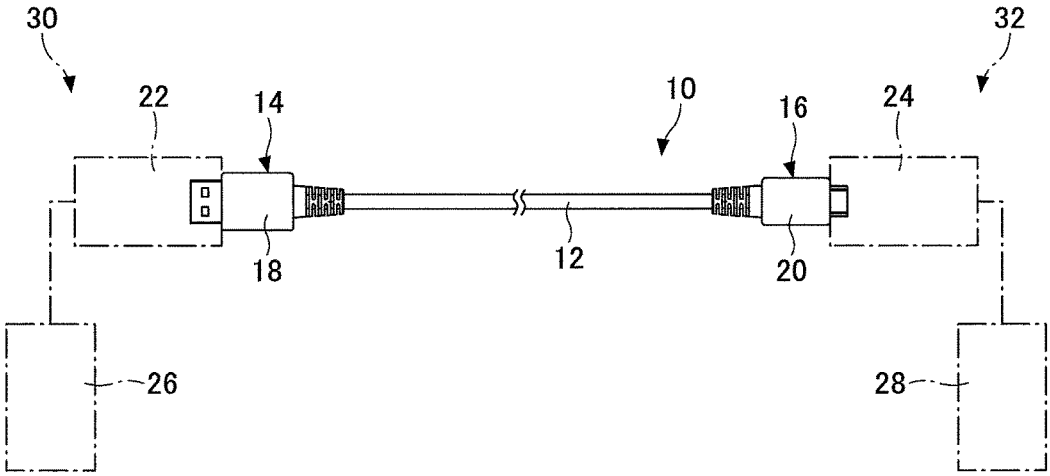
FIG. 2 is a drawing illustrating an example of a connecting condition of a USB cable according to an embodiment of the present invention.
Figure 3:
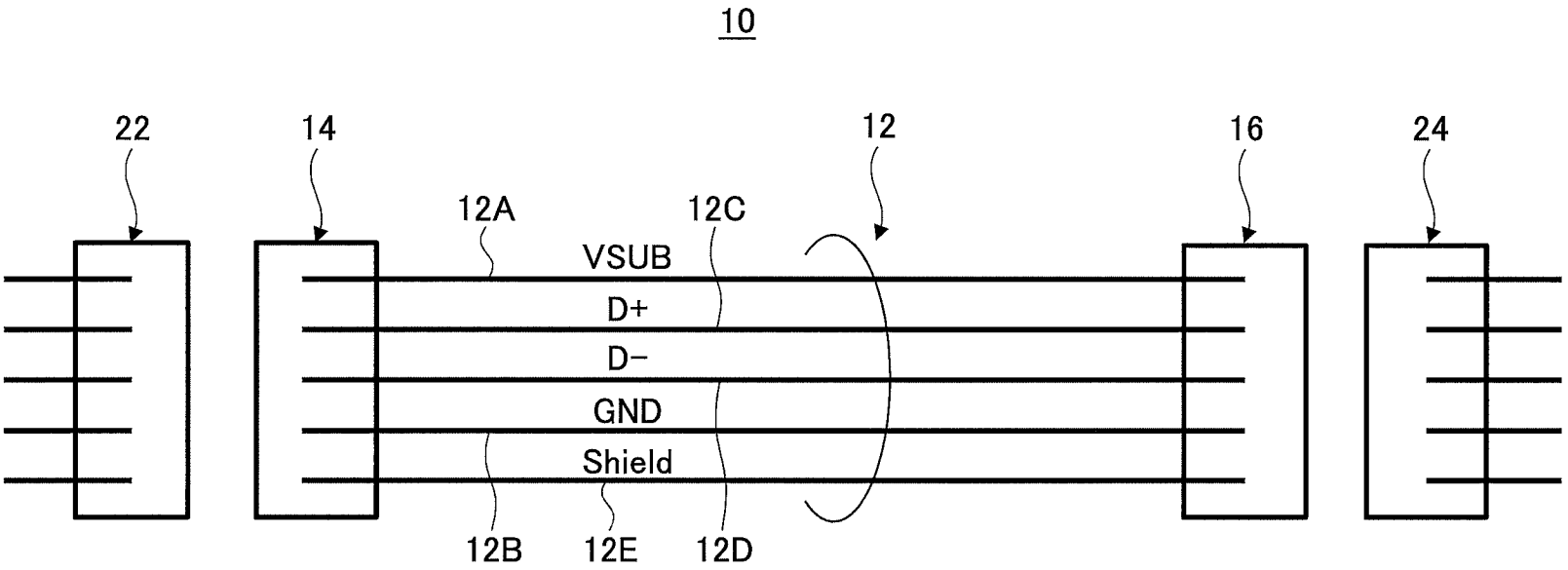
FIG. 3 is a diagram illustrating a cable structure of a USB cable according to an embodiment of the present invention.

FIGS. 1 through 3 illustrate a cable with a plug according to an embodiment of the preset invention. In the embodiment, a description is given below of the cable with the plug by citing an example of a USB (Universal Serial Bus) cable 10. However, an application of the present invention is not limited to a USB cable, but includes a variety of cables with a plug including a power supply line for power feeding.

FIGS. 1A and 1B are outside drawings of the USB cable 10. As illustrated in FIGS. 1A and 1B, the USB cable 10 includes a cable 12, a plug 14, and a plug 16. In the embodiment, the plug 14 is an A-type plug (which is hereinafter referred to as an "A-type plug 14") that meets the USB standard, and the plug 16 illustrates an example of a micro B-type plug (which is hereinafter referred to as a "μB-type plug 16").

However, a type of a plug provided at both ends of the cable 12 is not limited to the plugs 14 and 16, and configuring the cable 12 by using a plug not in accordance with the USB standard is possible. In addition, when a secondary-cell-side electronic device 32 driven by a secondary cell 28 (see FIG. 2) described later has a unique plug, using the unique plug is also possible.

As illustrated in FIG. 3, the cable 12 includes a positive power source line (VBUS line) 12A, a negative power source line (GND line) 12B, a positive signal line (D+ line) 12C, a negative signal line (D− line) 12D, and a shield line (Shield line) 12E for shielding each of the lines 12A through 12D. The A-type plug 14 is attached to an end of the cable 12 and the μB-type plug 16 is attached to the other end of the cable 12.

The A-type plug 14 includes terminals that are each connected with lines 12A through 12D of the cable 12 inside a housing 18 (see also FIGS. 1A and 1B). The μB-type plug 16 includes a circuit board 40 that is connected to each of the lines 12A through 12D inside a housing 20 (see also FIGS. 1A and 1B).

The housings 18 and 20 are made of resin. Insulating resin such as TPE resin (thermoplastic elastomer resin) can be used as a resin material forming the housings 18 and 20. In particular, when the insulating resin such as the TPE resin is used as the material of the housing 20, the circuit board 40 (see FIG. 5) inside the housing 20 can be mechanically protected, and even from the external environment including humidity, temperature and the like.

FIG. 2 illustrates an example of a use pattern of the USB cable 10. In the example illustrated in FIG. 2, the A-type plug 14 is connected to a power-source-side receptacle 22 of a power-source-side electronic device 30 including a power source 26. The power-source-side receptacle 22 is connected to the power source 26.

Moreover, the μB-type plug 16 is connected to a secondary-cell-side receptacle 24 of a secondary-cell-side electronic device 32 including a secondary cell 28. The secondary-cell-side receptacle 24 is connected to the secondary cell 28.

The power-source-side electronic device 30 is an electronic device such as a personal computer (PC) or the like, and the power source 26 is, for example, an AC adapter, a battery, a USB terminal of a PC or the like. For example, the secondary-cell-side electronic device 32 is a mobile terminal device, and the secondary cell 28 is a lithium-ion cell or the like.

The USB cable 10 includes the VBUS line 12A for power feeding. Hence, by loading the A-type plug 14 and the μB-type plug 16 in the power-source-side receptacle 22 and the secondary-cell-side receptacle 24, respectively, the secondary cell 28 can be charged by the power source 26 through the USB cable 10.

In the meantime, a foreign substance is liable to intrude into the plugs 14 and 16 when the plugs 14 and 16 are inserted in/pulled out of the receptacles 22 and 24, respectively. When the foreign substance has conductivity, a short is liable to occur between terminals inside each of the A-type plug 14 and the μB-type plug 16.

In particular, when using the μB-type plug 16 having a plug shape smaller than the A-type plug 14, even a foreign substance that is likely to readily release from the A-type plug 14 may remain in the μB-type plug 16. In addition, because the μB-type plug 16, which is small type, has a small distance between the terminals therein, even a small foreign substance may cause a short between the terminals.

If a short is generated inside the μB-type plug 16 caused by an intrusion of a foreign substance, the following phenomenon may be caused in the μB-type plug 16. That is, when impedance of the foreign substance is high, the heat generation occurs in the foreign substance and a temperature of the μB-type plug 16 increases (a state of which may be hereinafter referred to as an "abnormal temperature state"). On the other hand, when the impedance of the foreign substance is low, a current much higher than that at the normal time (a state of the foreign substance not intruding) flows (a state of which may be hereinafter referred to as an "over discharge state").

When a location having the highest temperature of the heat caused by the intrusion of the foreign substance was examined inside the μB-type plug 16, install locations of VBUS terminal 42 and the GND terminal 48 (see FIG. 4) had the highest temperature.

The USB cable 10 of the embodiment includes a control circuit 11 configured to interrupt the power feeding in the abnormal temperature state or the over discharge state by the intrusion of the foreign substance and the like. A description is given below of the control circuit 11 provided in the USB cable 10.

Figure 4:
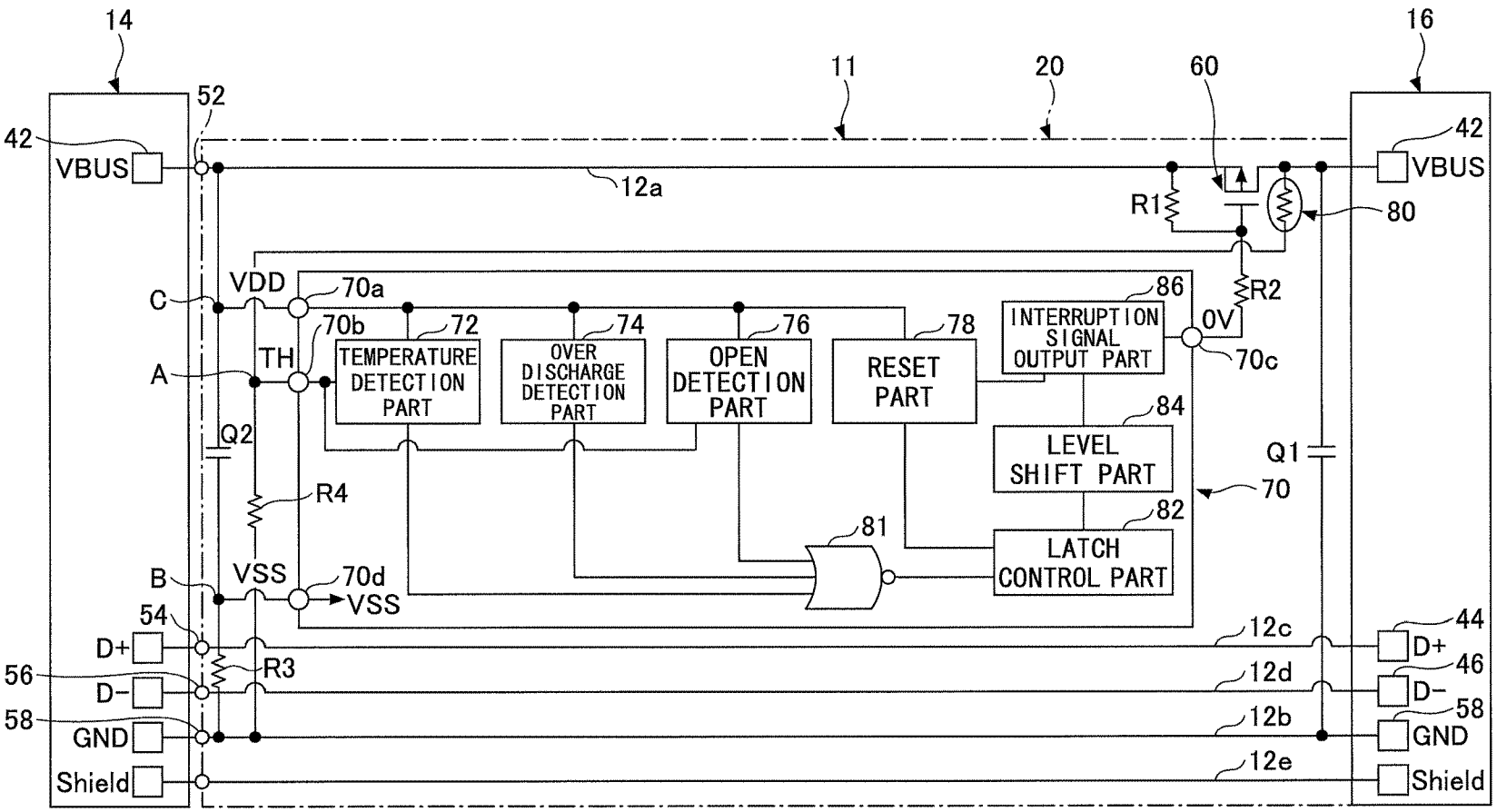
FIG. 4 is a block diagram of a control circuit mounted on a USB cable according to an embodiment of the present invention.

FIG. 4 is a block diagram of the control circuit 11.

The control circuit 11 is provided inside the housing 20 of the μB-type plug 16. More specifically, the circuit board 40 is provided in the housing 20, and the control circuit 11 is mounted on this circuit board 40 (see FIGS. 1A though 2, and 4).

The control circuit 11 includes interconnections 12*a* through 12*d*, an FET 60, a control IC 70, and a temperature sensor 80.

A VBUS line 12*a* is an interconnection connected to the VBUS line 12A of the cable 12. (see also FIG. 3) A GND line 12*b* is an interconnection connected to the GND line 12B of the cable 12. A D+ line 12*c* is an interconnection connected to the D+ line 12C of the cable 12. A D− line 12*d* is an interconnection connected to the D− line 12D.

The FET 60 is connected to the VBUS line 12*a* in series, and functions as a current interruption switch to interrupt a current flowing through the VBUS line 12*a*. The gate of this FET 60 is connected to an interruption signal output terminal (OV terminal) 70*c* of the control IC 70 through a resistor R2.

The FET 60 is a P-channel MOSFET (Metal Oxide Semiconductor Field Effect Transistor). Thus, the FET 60 turns on and off depending on an interruption signal output from the OV terminal 70*c*.

In other words, when the interruption signal output from the OV terminal 70*c* is at a low level, the FET 60 is turned on, and a current flows through the VBUS line 12*a*. In contrast, the interruption signal output from the OV terminal 70*c* is at a high level, the FET 60 turns off, and the current flowing through the VBUS 12*a* is interrupted. Here, a resistor R1 is a pull-up resistor connected in parallel with the FET 60.

Although the embodiment illustrates an example of using the P-channel MOSFET as the current interruption switch that interrupts the current flowing through the VBUS line 12*a*, an N-channel MOSFET can be used as the current interruption switch. Moreover, a semiconductor switch such as a bipolar transistor (PNP or NPN transistor), a mechanical relay and the like are also available.

In the embodiment, an NTC (Negative Temperature Coefficient) thermistor 80 that decreases its resistance with increasing temperature is used as a temperature sensor. The NTC thermistor 80 is arranged in the vicinity of a VBUS terminal 42 or a GND electrode 58 (which is described later in detail). A description is given below of an example of arranging the NTC thermistor 80 in the vicinity of the VBUS terminal 42.

The NTC thermistor 80 and a resistor R4 constitute a series circuit, and the NTC thermistor 80 is provided between the VBUS line 12*a* and the GND line 12*b*. Furthermore, a connection point A between the NTC thermistor 80 and the resistor R4 is connected to a temperature detection terminal (TH terminal) 70*b* of the control IC 70.

Hence, a temperature detection voltage input into the TH terminal 70*b* becomes a voltage divided by the NTC thermistor 80 and the resistor R4. In other words, the temperature detection voltage TH input into the TH terminal 70*b* varies depending on a resistance value of the NTC thermistor 80 that varies depending on a temperature change of the VBUS terminal 42.

Here, a capacitor Q1, and a series circuit constituted of a capacitor Q2 and a resistor R3 are connected between the VBUS line 12*a* and the GND line 12*b* in parallel with each other. The capacitors Q1 and Q2 are provided to prevent a noise from intruding into the control IC 70.

Moreover, a connection point B of the capacitor Q2 and the resistor R3 is connected to a VSS terminal 70*d* of the control IC 70. Furthermore, a connection point provided between the VBUS line 12*a* and the capacitor Q2 is connected to a VDD terminal 70*a* of the control IC 70.

The control IC 70 includes a temperature detection part 72, an over discharge detection part 74, an open detection part 76, a reset part 78, a NOR gate 81, a latch control part 82, and an interruption signal output part 86.

As described above, when a short occurs in the μB-type plug 16 caused by the intrusion of a foreign substance into the μB-type plug 16, a temperature of the VBUS terminal 42 increases, and the μB-type plug 16 goes into an abnormal temperature state. The temperature detection part 72 detects that the VBUS terminal 24 is at an abnormal temperature based on a voltage VDD input from the VDD terminal 70*a* and the temperature detection voltage TH input from the NTC thermistor 80 through the TH terminal 70*b*. When detecting the abnormal temperature, the temperature detection part 72 sends an abnormal temperature detection signal to the NOR gate 81. In the embodiment, when the temperature detection voltage TH is equal to or greater than 84% of a reference voltage (TH>VDD×0.84), it is determined that the VBUS terminal is at an abnormal temperature. In the following description, the voltage of 84% of the reference voltage VDD may be referred to as an abnormal temperature detection voltage.

The over discharge detection part 74 determines that an over discharge occurs when the voltage VDD input from the VDD terminal 70*a* is equal to or lower than a predetermined threshold voltage, and sends an over discharge detection signal to the NOR gate 81. As described above, when the impedance of the foreign substance having intruded into the μB-type plug 16 is small, a current much larger than the normal time flows, thereby decreasing the voltage of the VDD terminal 70*a* connected to the VBUS line 12*a*. Accordingly, the over discharge detection part 74 can detect the occurrence of short in the μB-type plug 16 from the voltage value of the voltage VDD.

The threshold voltage that becomes a reference to detect the over discharge has to meet two conditions of (a) being equal to or lower than the minimum voltage of an available area where the short does not occur, and (b) not causing resin covering the housing 20 and the cable 12 to be melted when the short occurs. In the embodiment, since the VDD, the maximum current and the cable impedance of the cable 12 are set at (5 V±5%), 3 A and 300 mΩ, respectively, the threshold voltage Vsh becomes as follows: Vsh=4.75 V−3 A×300 mΩ=3.85 V.

When a voltage setting meeting the above condition of (b) is low, because a period of time until reaching the threshold voltage Vsh to detect the short lengthens and the resin is liable to melt during the period of time, the threshold voltage is preferred to be higher. The threshold voltage Vsh needs to take into consideration the detection dispersion of the control IC 70. Therefore, in the embodiment, the threshold voltage Vsh is set at 3.5V. Here, the threshold voltage Vsh to detect the over discharge has to be set properly depending on a current value while supplying electricity, the impedance of the cable 12 and the like.

The open detection part 76 is to detect the abnormality of the NTC thermistor 80. When the NTC thermistor 80 is in a state of not operating properly (open state), an appropriate abnormal temperature detection cannot be performed.

In response to this, in the configuration of the embodiment, the open detection part 76 detects that an abnormality occurs in the NTC thermistor 80 and sends a sensor abnormal signal to the NOR gate 81 when the abnormality occurs. The abnormality detection of the NTC thermistor 80 is determined based on the VDD voltage input from the VDD terminal 70*a* and the temperature detection voltage TH input from the TH terminal 70*b*.

The NOR gate 81 outputs an abnormality detection signal of a low level to the latch control part 82 when the abnormal temperature detection signal is provided from the temperature detection part 72; the over discharge detection signal is provided from the over discharge detection part 74; or the sensor abnormal signal is provided from the open detection part 76.

The abnormality detection signal provided for the latch control part 82 is provided for an interruption signal output part 86 after being raised to a predetermined voltage by a level shift process. The interruption signal output part 86 provides an interruption signal of a high level to the FET 60 through the OV terminal to interrupt the FET 60 upon receiving the abnormality detection signal.

The FET 60 turns off and interrupts the VBUS line 12*a* upon receiving the interruption signal of the high level from the interruption signal output part 86 at its gate. This enables the power feeding through the VBUS line 12*a* and the GND line 12*b* to be stopped, thereby preventing the USB cable 10, the power-source-side electronic device 30 and the secondary-cell-side electronic device 32 from being damaged and the housing 20 and the cable 12 from being melted by the heat, even if a foreign substance intrudes into the μB-type plug 16 and a short occurs in the μB-type plug 16.

Moreover, the latch control part 82 holds an off status of the FET 60 (i.e., latches) until receiving a reset signal from the reset part 78 described later upon receiving the abnormality detection signal from the NOR gate 81. Thus, after the FET 60 is turned off, even if the temperature of the VBUS terminal 42 or the voltage VDD of the VDD terminal 70*a* temporarily returns to a normal value, the VBUS line 12*a* does not conduct. Accordingly, in an abnormal state, the FET 60 can be prevented from repeating on and off alternately, and the USB cable 10 can be reliably prevented from being damaged.

The reset part 78 holds a latch state of the latch control part 82 until the voltage of the VDD terminal 70*a* becomes a predetermined voltage or lower. In the embodiment, the reset part 78 is configured to monitor the voltage of the VDD terminal 70*a* and to release the latch of the latch control part 82 when the voltage of the VDD terminal 70*a* becomes 1.8 V or lower. Furthermore, the FET 60 is directly controlled by a control signal provided from the reset part 78.

Here, in the USB cable 10, for example, when the power feeding from the power source 26 is stopped (when the USB cable 10 is pulled out of the power-source-side electronic device 30) or the power source voltage of the power source 26 decreases (when charging by a battery), the voltage of the VDD terminal 70*a* becomes equal to or lower than 1.8 V.

Figure 5A:
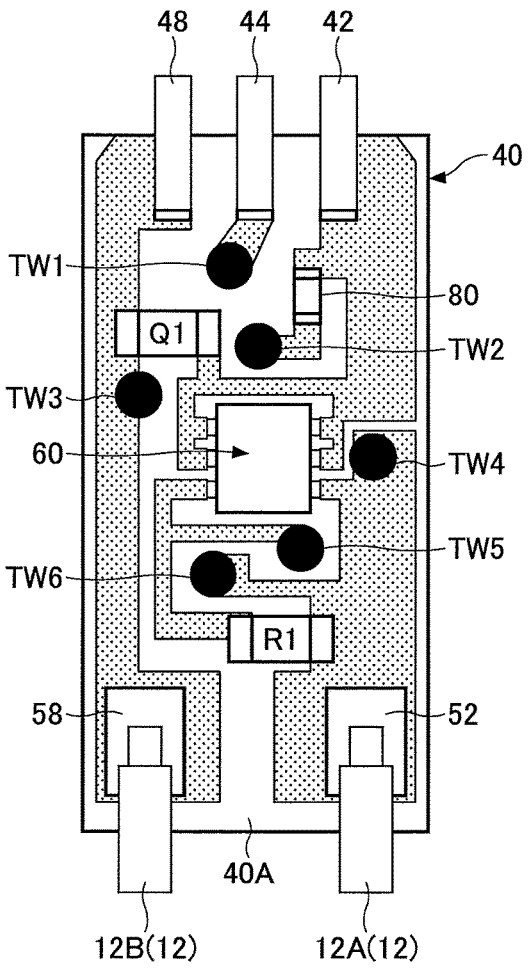
FIGS. 5A and 5B are diagrams illustrating a circuit board provided in a housing of a USB cable according to an embodiment of the present invention.
Figure 5B:
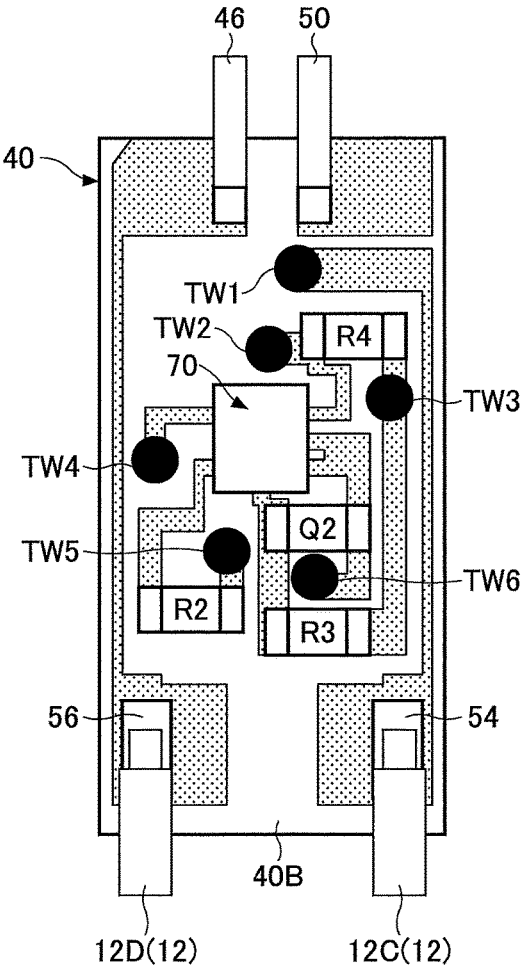

FIGS. 5A and 5B illustrate a circuit board 40 on which the control circuit 11 configured as above is mounted.

FIG. 5A illustrates an upper surface 40A of the circuit board 40. The VBUS terminal 42, a D+ terminal 44, the GND terminal 48, a VBUS electrode 52, a GND electrode 58, the FET 60, the NTC thermistor 80, the resistor R1, and the capacitor Q1 are provided on the upper surface 40A. Each of the electronic devices is connected to each other through a printed wiring (illustrated by pearskin finish) formed on the upper surface 40A. This printed wiring forms the VBUS line 12*a*, the GND line 12*b*, the D+ line 12*c*, and the D− line 12*d*.

The VBUS terminal 42, the D+ terminal 44 and the GND terminal 48 are terminals to be connected with the secondary-cell-side receptacle 24. Furthermore, the VBUS line 12A of the cable 12 is connected to the VBUS electrode 52. The GND line 12B of the cable 12 is connected to the GND line 58.

FIG. 5B illustrates a back surface 40B of the circuit board 40. A D− terminal 46, an OPEN terminal 50, a D+ electrode 54, a D− electrode 56, the control IC 70, the resistors R2 and R4, and the capacitor Q2 are provided on the back surface 40B. Each of the electronic devices is connected to each other through a printed wiring (illustrated by pearskin finish) formed on the back surface 40B.

The D− terminal 46 and the OPEN terminal 50 are terminals to be connected with the secondary-cell-side receptacle 24. The D+ line 12C of the cable 12 is connected to the D+ electrode 54, and the D− line 120 of the cable 12 is connected to the D− electrode 56. In addition, the printed wirings formed on the upper surface 40A and the back surface 40B are connected with each other by way of through holes TW1 through TW6 extending between the upper surface 40A and the back surface 40B.

In the embodiment, electronic devices needed to be made low impedance are intensively disposed on the upper surface 40A, and electronic devices needed to be made high impedance are intensively disposed on the back surface 40B. Thus, the electronic devices needed to be made low impedance can be efficiently driven. Moreover, in the embodiment, the FET 60 and the control IC 70 that have relatively large shapes are separately arranged on the upper surface 40A and the back surface 40B, respectively. This enables an area of the circuit board 40 to decrease, thereby forming the μB-type plug 16 having a compact shape even if including the circuit board 40 therein.

Here, pay attention to the disposed position of the NTC thermistor 80. In the embodiment, the NTC thermistor 80 is arranged at a position close to the VBUS terminal 42. Moreover, the VBUS terminal 42 is made of a copper alloy having preferable thermal conductivity, and is soldered to the printed wiring.

Hence, even if the VBUS line 12*a* and the GND line 12*b* short due to a conductive foreign substance attached to the VBUS terminal 42 connected to the secondary cell 28 and the heat is generated by causing a current to flow through the conductive foreign substance, the NTC thermistor 80 is installed at a location where the conductive foreign substance of a heating element is attached, that is a location close to (adjacent to) the VBUS terminal 42.

This causes the heat of the conductive foreign substance, which is the heating element, to transmit to the NTC thermistor in a short time, and an accurate temperature can be measured in a short time. This allows the control IC 70 to immediately turn off the FET 60 and to interrupt the VBUS line 12*a* when the temperature detected by the NTC thermistor 80 exceeds a predetermined temperature. This makes it possible to reliably prevent the μB-type plug 16, the secondary-cell-side receptacle 24, the secondary-cell-side electronic device 32 in which the secondary-cell-side receptacle 24 is installed, the cable 12, the power-source-side electronic device 30 and the like from being damaged.

Subsequently, a description is given below of operation of the control circuit configured as above.

Figure 6:
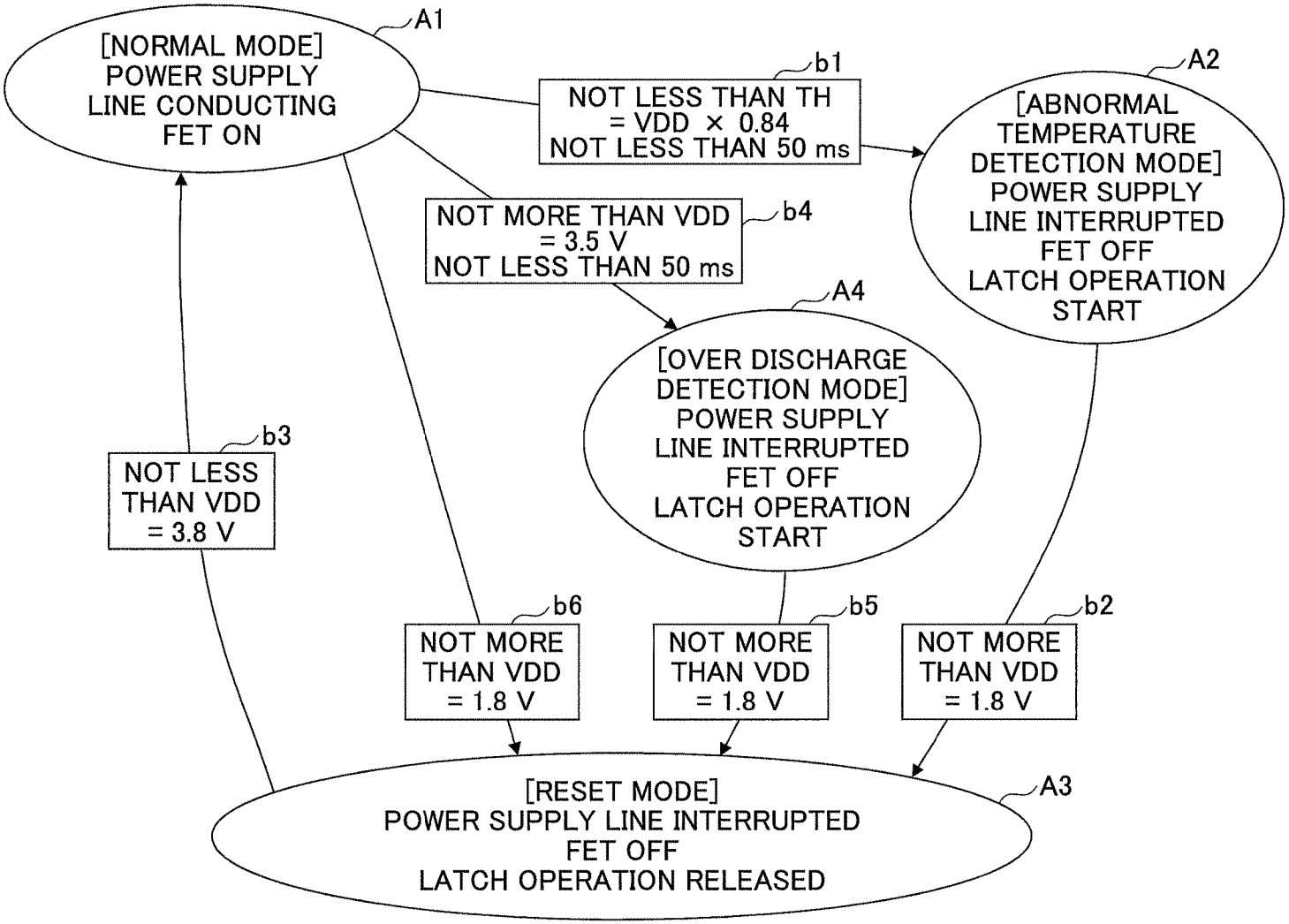
FIG. 6 is a state transition diagram for explaining a process performed by a control circuit according to an embodiment of the present invention.
Figure 7:
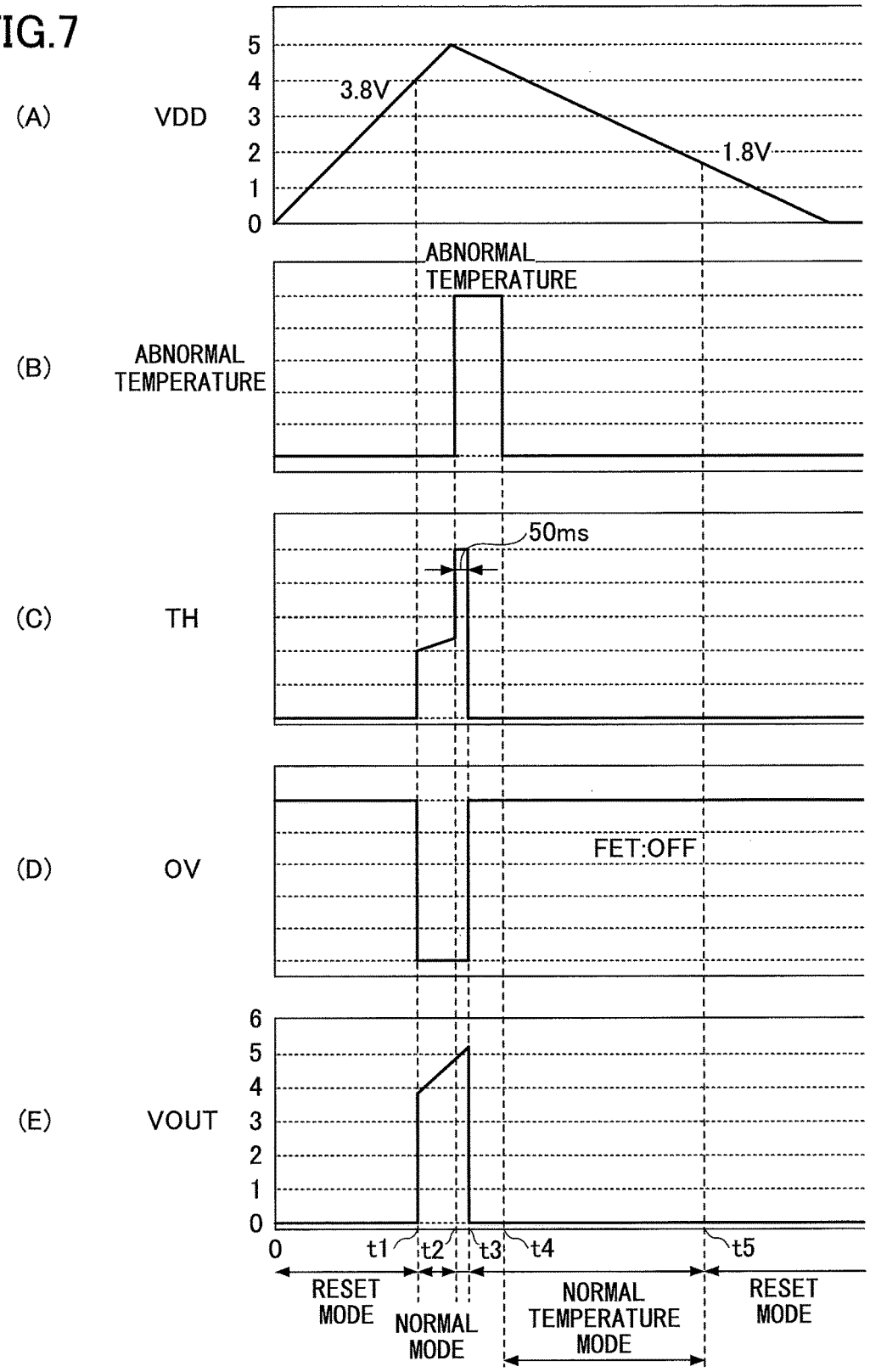
FIG. 7 is a timing chart when an abnormal temperature occurs for a predetermined period of time.
Figure 8:
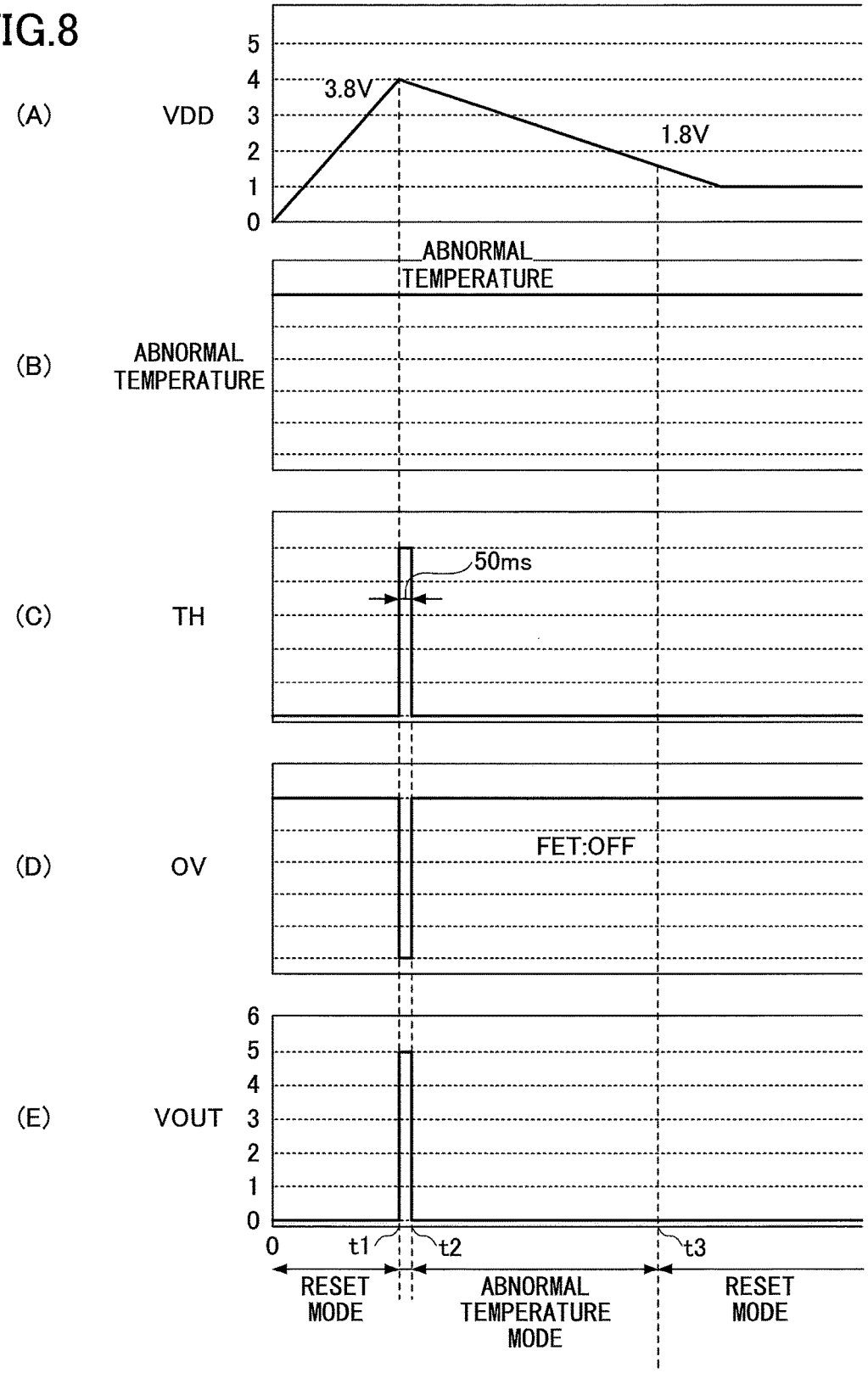
FIG. 8 is a timing chart when an abnormal temperature continuously occurs.
Figure 9:
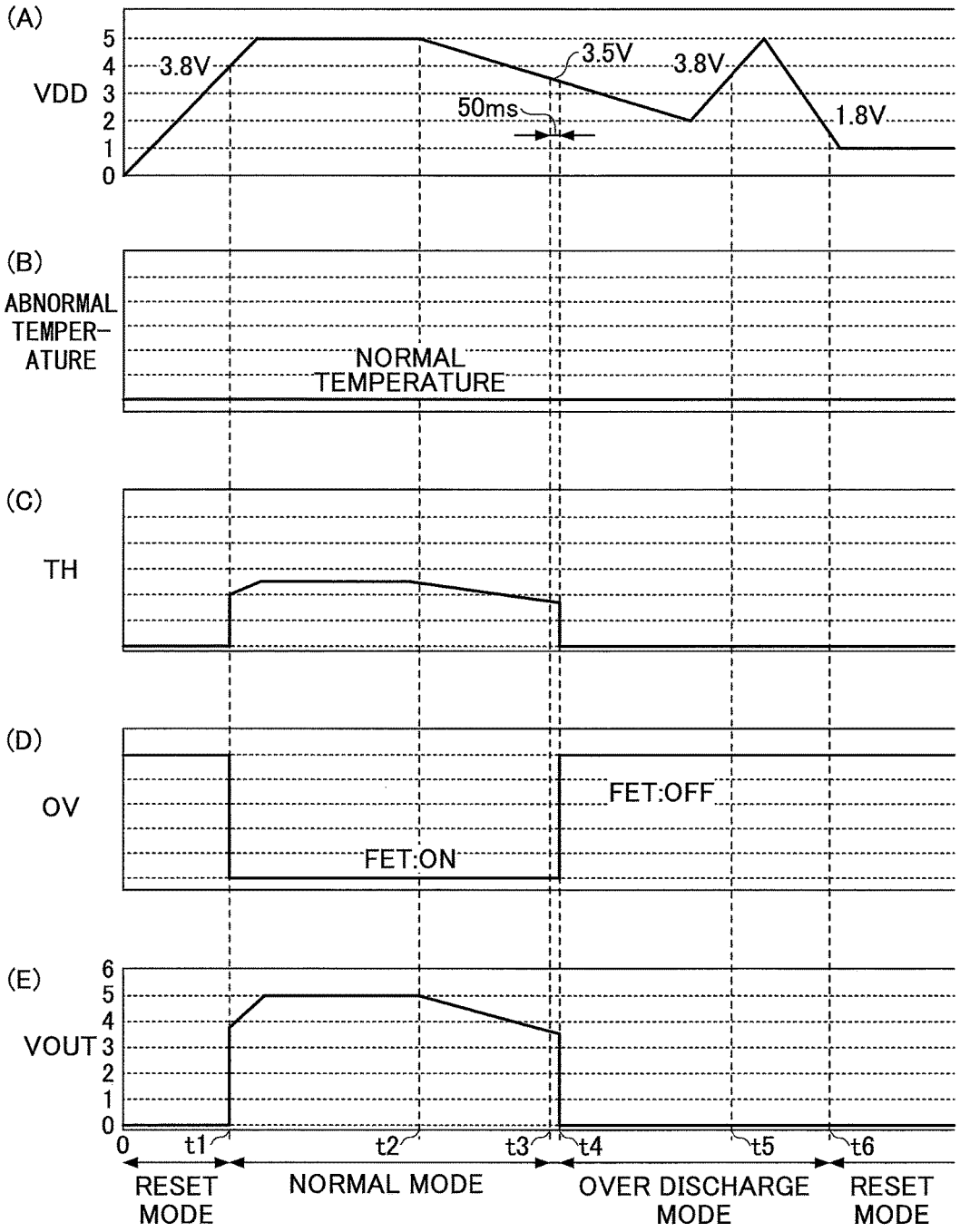
FIG. 9 is a timing chart when an over discharge is generated.

FIG. 6 is a state transition diagram illustrating an operation of the control circuit 11. FIG. 7 is a timing chart illustrating an operation of the control circuit 11 when an abnormal temperature occurs for a predetermined period of time. FIG. 8A is a timing chart illustrating an operation of the control circuit 11 when an abnormal temperature occurs continuously. FIG. 9 is a timing chart illustrating an operation of the control circuit 11 when an over discharge occurs for a predetermined period of time. FIG. 10A is a timing chart illustrating an operation of the control circuit 11 when a plug is pulled out of a receptacle.

Among FIGS. 7 through 10, FIGS. 7(A), 8(A), 9(A) and 10(A) illustrate voltages VDD of the VDD terminal 70*a*, and FIGS. 7(B), 8(B), 9(B) and 10(B) illustrate abnormal temperatures generated by intrusion of foreign substances. FIGS. 7(C), 8(C), 9(C) and 10(C) illustrate temperature detection voltages TH of the TH terminal 70*a*, and FIGS. 7(D), 8(D), 9(D) and 10(D) illustrate interruption signals output to the OV terminal. FIGS. 7(E), 8(E), 9(E) and 10(E) illustrate feeding voltage VOUT output from the μB-type plug 16.

As illustrated in FIG. 6, the control IC 70*a* of the embodiment includes a normal mode A1, an abnormal temperature detection mode A2, a reset mode A3 and an over discharge mode A4.

To begin with, a description is given below of an operation of the control circuit 11 when an abnormal temperature occurs for a predetermined period of time with reference to FIGS. 6 and 7.

In FIG. 7, time 0 illustrates time when the plugs 14 and 16 of the USB cable 10 are inserted into the receptacles 22 and 24, respectively. The control IC 70 is in the reset mode A3 before the plugs 14 and 16 are inserted into the receptacles 22 and 24, respectively. In the reset mode A3, the FET 60 is in an off status, and the latch by the latch control part 82 is released. Here, in examples of FIG. 7, the over discharge does not occur.

The control IC 70 is in the reset mode A3, a voltage is applied to the VBUS electrodes 52 from the power source 26, thereby accumulating charge in the capacitor Q2 and the like. Hence, as illustrated in FIG. 7(A), the voltage VDD of the VDD terminal 70*a* gradually rises.

The reset part 78 provided in the control IC 70 monitors the voltage VDD of the VDD terminal 70*a*. Then, when the control IC 70 detects that the voltage VDD of the VDD terminal 70*a* becomes 3.8 V or higher, the reset part 78 sends a normal state detection signal to the interruption signal output part 86 (a process shown by numeral b3 in FIG. 6). The interruption signal output part 86 outputs a low-level signal to the FET 60 through the OV terminal 70*c* upon receiving the normal state detection signal from the reset part 78.

This causes the FET 60 to turn on (see FIG. 7(C)), and the VBUS line 12*a* conducts, thereby causing the USB cable 10 to goes into a normal mode A1. By allowing the control IC 70 to go into the normal mode A1, the feeding voltage VOUT increases, and charging the secondary-cell 28 starts.

FIG. 7 illustrates an example of the temperature of the VBUS terminal 42 becoming an abnormal temperature between time t2 and t4 due to the intrusion of a foreign substance into the μB-type plug 16.

Because the NTC thermistor 80 is disposed at a position close to the VBUS terminal 42, when the temperature of the VBUS terminal 42 becomes an abnormal temperature, the generated heat transmits to the NTC thermistor 80 in a short time. This causes the resistance of the NTC thermistor 80 to decrease, thereby increasing the temperature detection voltage TH of the TH terminal 70*b*.

The temperature detection part 72 sends an abnormal temperature detection signal to the NOR gate 81 when determining that the temperature detection voltage TH is equal to or higher than the abnormal temperature (voltage of 84% of the reference voltage VDD) and that the status has lasted 50 ms (a process shown by a numeral b3 in FIG. 6).

Here, the abnormal temperature detection signal is not sent immediately after the temperature detection voltage TH becomes equal to or higher than the abnormal temperature detection voltage but held for 50 ms (from time t2 to time t4) in order to exclude an instantaneous variation of the temperature detection voltage due to a disturbance and the like.

When the abnormal temperature detection signal is sent to the NOR gate 81, the NOR gate 81, the latch control part 82, the level shift part 84 and the interruption signal output part 86 perform the predetermined process discussed above, thereby turning off the FET 60 and causing the control IC 70 to enter the abnormal temperature detection mode A2. In the abnormal temperature detection mode A2, the VBUS line 12*a* is interrupted, and charging the secondary cell 28 is stopped (see FIG. 7(E)). In addition, the FET 60 continues to turn off because the latch control part 82 starts in the abnormal temperature detection mode A2 (see FIG. 7(D)).

In the abnormal temperature detection mode A2, the FET 60 continues to turn off by the latch control part 82. Thus, as illustrated in FIG. 7, even if the abnormal temperature state terminates at time t4 and the temperature of the VBUS terminal 42 returns to a normal temperature, the control IC 70 maintains the abnormal temperature detection mode A2.

In this manner, even if the temperature of the VBUS terminal 42 temporarily returns to a normal value, the control IC 70 maintains a state of interrupting the VBUS line 12*a*. If the FET 60 is turned on when the temperature of the VBUS terminal 42 temporarily returns to the normal value, the FET 60 turns off again if the temperature goes into the abnormal state again. When the FET 60 repeats turning on and off as mentioned above, the rise of the temperature cannot be suppressed.

Hence, as described in the embodiment, the control IC 70 is configured to maintain the state of interrupting the VBUS line 12*a* even if the temperature of the VBUS terminal 42 temporarily becomes a normal value, which makes it possible to prevent the USB cable 10, the power source 26, the secondary cell 28 and the like from being damaged.

When the power source 26 is turned off, or the A-type plug 14 of the cable 10 is pulled out of the receptacle 22, the VDD voltage of the VDD terminal 70*a* gradually reduces (see FIG. 7(A)). The reset part 78 monitors the voltage VDD of the VDD terminal 70*a*.

Then, when detecting that the voltage VDD of the VDD terminal 70*a* is 1.8 V or lower, the reset part 78 sends a latch release signal to the latch control part 82 (a process shown by a numeral b2 in FIG. 6). The latch control part 82 releases the latch state of the FET 60 upon receiving the latch release signal from the reset part 78. This causes the control IC 70 to enter the reset mode A3 again (the control IC 70 goes into the rest mode A3 at time t5 in the example illustrated in FIG. 7).

In the reset mode A3, the FET 60 maintains the off state (see FIG. 7(D)). However, the control of turning the FET 60 on is possible in the reset mode A3. This reset state is continued until the USB cable 10 is pulled out of the receptacle 22, 24, or the power feeding from the power source 26 is stopped, for example.

Next, a description is given below of an operation of the control circuit 11 when an abnormal temperature occurs continuously with reference to FIGS. 6 and 8.

In the example illustrated in FIGS. 7A through 7E, an example of the abnormal temperature occurring only between time t2 and time t4 is illustrated. In contrast, in an example illustrated in FIG. 8, the temperature of the VBUS terminal 42 is already at an abnormal temperature from the time the plugs 14 and 16 of the USB cable 10 are inserted into the receptacles 22 and 24, respectively (from time 0).

As discussed above, the control IC 70 is in the reset mode A3 before the plugs 14 and 16 are inserted into the receptacles 22 and 24, respectively. The reset part 78 provided in the control IC 70 monitors the voltage VDD of the VDD terminal 70*a*, and sends a normal state detection signal to the interruption signal output part 86 when detecting that the voltage VDD is equal to or higher than 3.8 V (a process shown by a numeral b3 in FIG. 6).

The interruption signal output part 85 outputs a low-level signal to the FET 60 through the OV terminal 70*c* upon receiving the normal state detection signal from the reset part 78, thereby turning the FET 60 on (turning on at time t1, see FIG. 8(D)).

The example illustrated in FIGS. 8A through 8E illustrates an example of the temperature of the VBUS terminal 42 being continuously an abnormal temperature. Hence, when the FET 60 turns on, the temperature of the VBUS terminal 42 is already at an abnormal temperature. As mentioned above, the temperature detection part 72 sends an abnormal temperature detection signal to the NOR gate 81 when determining that the temperature detection voltage TH is equal to or higher than the abnormal temperature detection voltage (voltage higher than 84% of the reference voltage VDD) and that the status has continues 50 ms (the process shown by the numeral b1 in FIG. 6).

Accordingly, when the temperature of the VBUS terminal 42 is continuously at the abnormal temperature, the temperature detection part 72 sends an abnormal temperature detection signal to the NOR gate 81 after a lapse of 50 ms from the time the FET 60 turns on (time t2).

This causes the NOR gate 81, the latch control part 82, the level shift part 84 and the interruption signal output part 86 to perform the predetermined process, thereby turning the FET 60 off and keeping the FET 60 off by the latch control part 82 (see FIG. 8(D)).

Thus, the control IC 70 promptly goes into the abnormal temperature detection mode immediately after causing the abnormal temperature to be detected by turning on the FET 60 in a short time of 50 ms when the abnormal temperature occurs continuously.

By causing the FET 60 to turn on, the VBUS line 12*a* temporarily conducts, but the conduction time is a short time of 50 ms. Hence, even if the FET 60 temporarily turns on, the USB cable 10, the power source 26, the secondary cell 28 and the like cannot be damaged. Accordingly, even if the abnormal temperature occurs continuously, the control circuit 11 can reliably protect the USB cable 10, the power source 26, the secondary cell 28 and the like.

Next, a description is given below of an operation of the control circuit 11 when an over discharge occurs.

In an example illustrated in FIG. 9, time 0 indicates the time when the plugs 14 and 16 of the USB cable 10 are inserted into the receptacles 22 and 24, respectively, and the control IC 70 is in the reset mode A3. Moreover, by inserting the plugs 14 and 16 into the receptacles 22 and 24, respectively, the voltage of the power source 26 is applied to the VBUS electrode 52, thereby gradually increasing the voltage VDD of the VDD terminal 70*a*. Here, in the example illustrated in FIG. 9, the abnormal temperature does not occur.

The reset part 78 provided in the control IC 70 monitors the voltage VDD of the VDD terminal 70*a*, and sends a normal state detection signal to the interruption signal output part 86 when the voltage VDD is equal to or higher than 3.8 V (the process illustrated by the numeral b3 in FIG. 6).

Upon receiving the normal state detection signal from the reset part 78, the interruption signal output part 86 outputs a low-level signal to the FET 60 through the OV terminal 70*c*, and turns on the FET 60 (see FIG. 9(D)). The VBUS line 12*a* conducts and the USB cable 10 becomes the normal mode A1. When the control IC 70 goes into the normal mode A1, the feeding voltage VOUT increases and charging the secondary cell 28 is started.

FIG. 9 illustrates an example of an over discharge generated by a short between the VBUS terminal 42 and the GND electrode 58 at time t2 due to the intrusion of a foreign substance.

When the VBUS terminal 42 and the GND electrode 58 short and an over discharge occurs, the voltage VDD of the VDD terminal 70*a* decreases as illustrated in FIG. 9(A).

The over discharge detection part 74 monitors the voltage VDD of the VDD terminal 70*a*. Then, the over discharge detection part 72 sends an over discharge detection signal to the NOR gate 81 upon determining that the voltage VDD of the VDD terminal 70*a* is equal to or lower than the over discharge detection voltage (3.5 V in the embodiment) and that the status has continued 50 ms (the process illustrated by the numeral b4 in FIG. 6).

Here, the over discharge detection part 74 is configured not to send the over discharge detection signal immediately after the voltage VDD of the VDD terminal 70*a* is equal to or lower than the over discharge detection voltage (3.5 V in the embodiment) but to send the over discharge detection signal only after a lapse of 50 ms (time between t3 and t4) in order to exclude an instantaneous variation of the voltage VDD due to disturbance and the like.

When the abnormal temperature detection signal is sent to the NOR gate 81, the NOR gate 81, the latch control part 82, the level shift part 84 and the interruption signal output part 86 perform the predetermined process discussed above, thereby turning off the FET 60 and causing the control IC 70 to enter the over discharge detection mode A4. In the over discharge detection mode A4, the VBUS line 12*a* is interrupted, and charging the secondary cell 28 is stopped (see FIG. 9E). Moreover, because the latch control part 82 starts in the over discharge detection mode A4, the FET 60 is kept in an off state (see FIG. 9(D)).

In the over discharge detection mode A4, the FET 60 is kept in the off state by the latch control part 82. Hence, as illustrated in FIG. 9, even if the over discharge state terminates at time t5*m* the control IC 70 maintains the over discharge detection mode A4.

In this manner, even if the voltage VDD of the VDD terminal 70*a* temporarily becomes a normal value, because the control IC 70 maintains the state of interrupting the VBUS line 12*a*, the USB cable 10, the power source 26 and the secondary cell 28 and the like can be prevented from being damaged.

When the power source 26 is turned off or the A-type plug 14 of the USB cable 10 is pulled out of the receptacle 22, the VDD voltage of the VDD terminal 70*a* gradually decreases (see FIG. 9(A)), and the reset part 78 sends a latch release signal to the latch control part 82 (a process shown by a numeral b5 in FIG. 6). The latch control part 82 releases the latch state of the FET 60 upon receiving the latch release signal from the reset part 78. This causes the control IC 70 to become the reset mode A3 again (In the example illustrated in FIG. 9, the control IC 70 goes into the reset mode A3 at time t6).

Next, a description is given below of an operation of the control circuit 11 when a plug is pulled out of a receptacle with reference to FIGS. 6 and 10.

Figure 10:
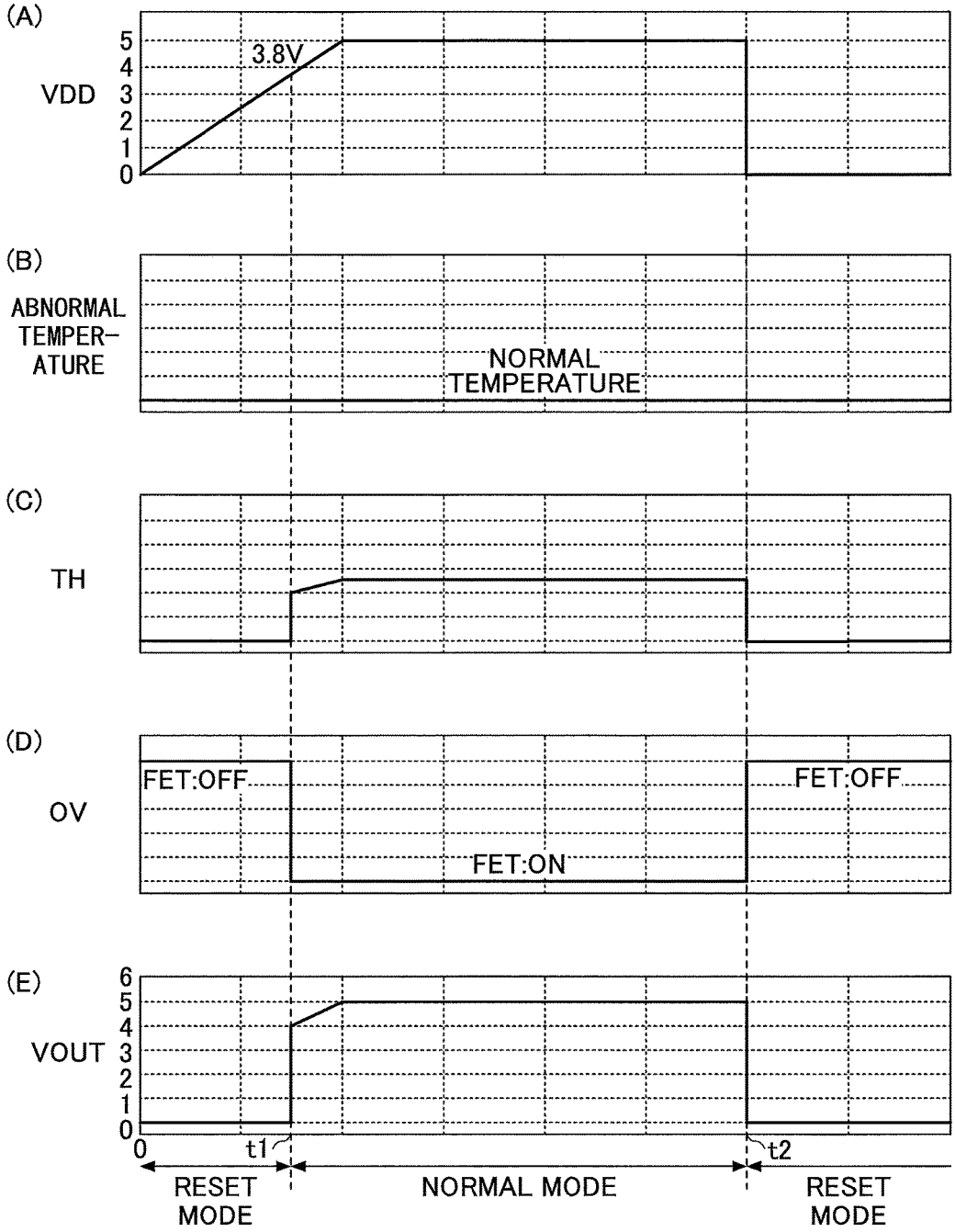
FIG. 10 is a timing chart when a plug is pulled from a receptacle.

In an example illustrated in FIG. 10, time 0 also indicates the time when the plugs 14 and 16 of the USB cable 10 are inserted into the receptacles 22 and 24, respectively, and the control IC 70 is in the reset mode A3. Moreover, by inserting the plugs 14 and 16 into the receptacles 22 and 24, respectively, the voltage of the power source 26 is applied to the VBUS terminal 52, thereby gradually increasing the voltage VDD of the VDD terminal 70*a*. Here, in the example illustrated in FIG. 10, it is assumed that an abnormal temperature and an over discharge do not occur.

The reset part 78 provided in the control IC 70 monitors the voltage VDD of the VDD terminal 70*a*, and sends a normal state detection signal to the interruption signal output part 86 when the control IC 70 detects that the voltage VDD of the VDD terminal 70*a* becomes 3.8 V or higher (a process shown by numeral b3 in FIG. 6).

The interruption signal output part 86 outputs a low-level signal to the FET 60 through the OV terminal 70*c* upon receiving the normal state detection signal from the reset part 78, and the FET 60 turns on (see FIG. 10(D)). The VBUS line 12*a* conducts and the USB cable 10 enters the normal mode A1. By causing the control IC 70 to enter the normal mode A1, the feeding voltage VOUT increases and charging the secondary cell 28 starts.

FIG. 10 illustrates an example of pulling the plugs 14 and 16 of the USB cable 10 out of the receptacles 22 and 24, respectively.

The reset part 78 monitors the voltage VDD of the VDD terminal 70*a* even when the control IC 70 is in the normal mode A1. By pulling the plugs 14 and 16 out of the receptacles 22 and 24, the voltage VDD of the VDD terminal 70*a* becomes zero (see FIG. 10(A)). In other words, the voltage VDDD of the VDD terminal 70*a* becomes 10.8 V or lower.

When the VEE voltage of the VDD terminal 70*a* becomes 1.8 V or lower, the reset part 78 sends a latch release signal to the latch control part 82 (the process shown by the numeral b3 in FIG. 6). The latch control part 82 releases the latch state of the FET 60 upon receiving the latch release signal from the reset part 78. This causes the control IC 70 to enter the reset mode A3 when the plugs 14 and 16 of the USB cable 10 are pulled out of the receptacles 22 and 24, respectively, in the normal mode A1 (in the example illustrated in FIG. 10, the control IC 70 enters the reset mode A3 at time t2).

In the meantime, in the above-mentioned abnormal temperature detection process, the NTC thermistor 80 detects the temperature increase of the VBUS terminal 42 or the GND electrode 58 due to the intrusion of a foreign substance, and when detecting that the temperature detection voltage inserted into the TH terminal is equal to or higher than a predetermined threshold, it is determined that an abnormal temperature occurs, and then the normal mode A1 is switched to the abnormal temperature detection mode A2.

However, the detection of the abnormal temperature is not limited to this, but can be also performed by providing a temperature change rate detection circuit configured to detect a change rate of increasing temperature in the control IC. A description is given below of a method of detecting an abnormal temperature based on a change rate of increasing temperature.

The temperature change rate detection circuit is provided in place of the temperature detection part 72 illustrated in FIG. 4. Moreover, hereinafter, a description is given below of an example of using a temperature sensor configured to measure a temperature *T* of the VBUS terminal 42 or the GND terminal 58 in place of the NTC thermistor 80.

Here, the temperature sensor is disposed at a position close to the VBUS terminal 42 or the GND electrode 58 (a position where heat conduction preferably occurs) as well as the NTC thermistor 80.

Figure 11:
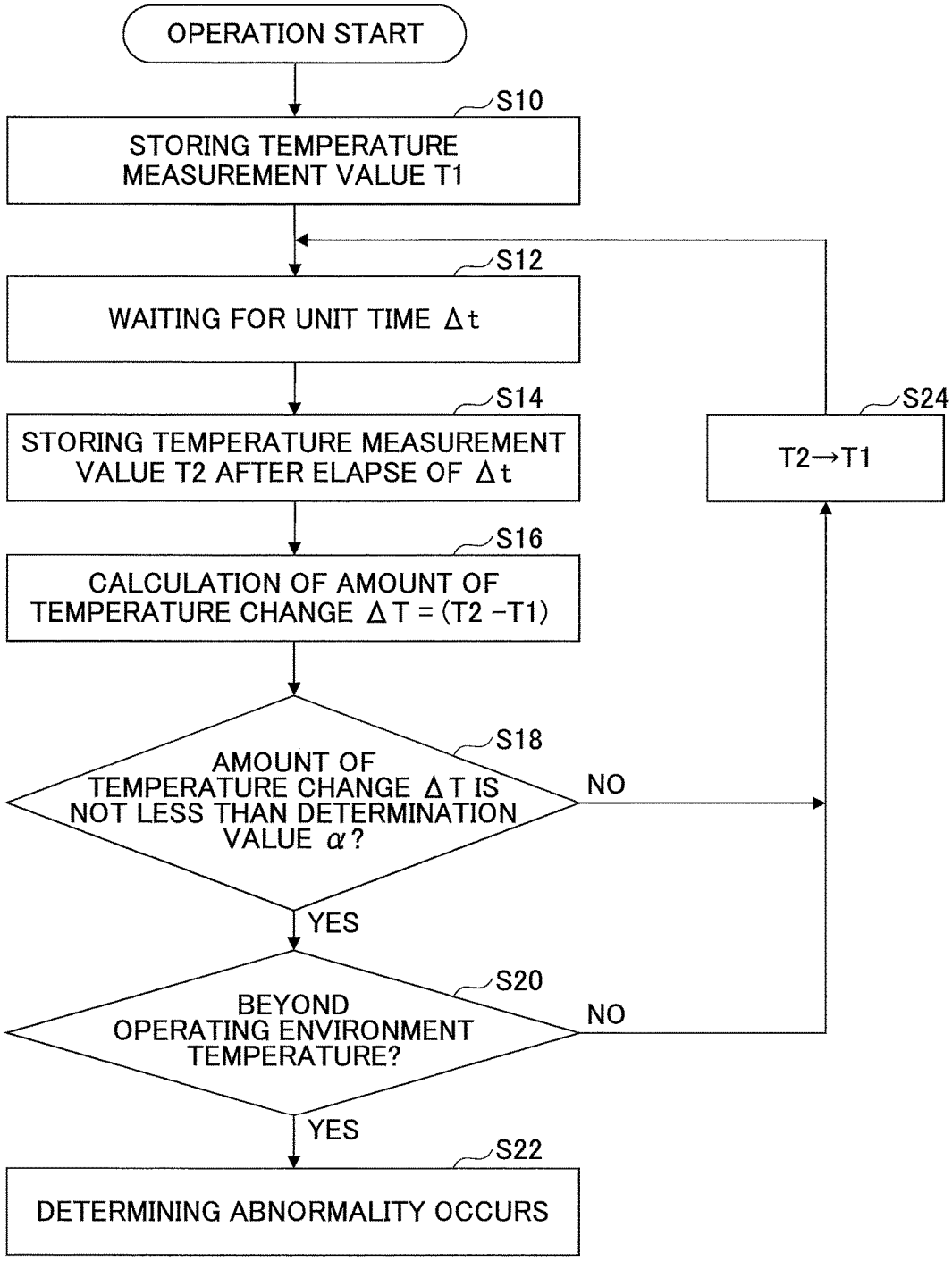
FIG. 11 is a flowchart illustrating another embodiment that performs abnormal temperature detection.
Figure 12:
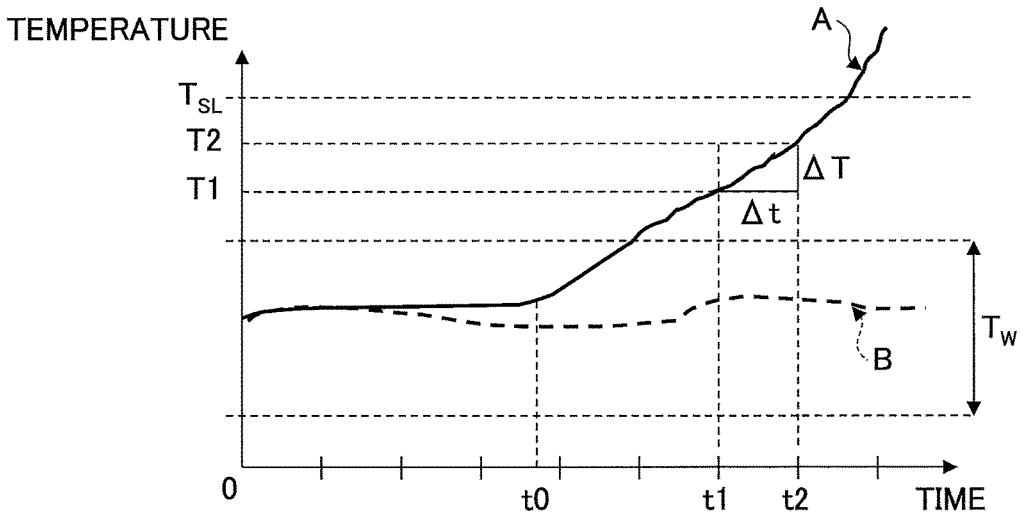
FIG. 12 is a diagram for explaining a principle of performing abnormal temperature detection according to another embodiment of the present invention.

FIG. 11 is a flowchart illustrating a temperature detection process performed by the temperature change rate detection circuit, and FIG. 12 is a diagram for explaining a principle of the temperature detection process.

To begin with, a description is given below of the principle of the temperature detection process according to an embodiment. In FIG. 12, the horizontal axis indicates time, and the vertical axis indicates a temperature detected by the temperature sensor. In FIG. 12, a solid line indicated by an arrow A shows a temperature change in the abnormal temperature detection mode A2 where the abnormal temperature occurs, and a dashed line indicated by an arrow B shows a temperature change in the normal mode A1 without the intrusion of a foreign substance.

With reference to the temperature change B in the normal mode A1, a change rate per unit time is small, and the temperature is approximately constant. In contrast, with reference to the temperature change A in the abnormal temperature detection mode A2, a change rate per unit time is great. For example, with respect to the change rate per unit ($\Delta t = t2 - t1$), a temperature change does not substantially occur un the temperature B in the normal mode A1, but a temperature change indicated by $\Delta T$ occurs in the temperature change A in the abnormal temperature detection mode A2.

In this manner, because the temperature change per unit time (which is referred to as a "temperature change rate") is great in the abnormal temperature detection mode A2, the abnormal temperature detection mode A2 can be detected by acquiring the temperature change rate.

Furthermore, a temperature $T_{SL}$ illustrated in FIG. 12 indicates a temperature corresponding to the condition b1 to cause the control IC 70 to shift from the normal mode A1 to the abnormal temperature detection mode A2. As illustrated in FIG. 12, in the embodiment discussed above, the control IC 70 does not shift from the normal mode A1 to the abnormal temperature detection mode A2 until the temperature of the VBUS terminal 42 or the GND electrode 58 does not exceed the temperature $T_{SL}$.

However, in the embodiment, even if the temperature of the VBUS terminal 42 or the GND electrode 58 is equal to or lower than the temperature $T_{SL}$, when the temperature change rate exceeds a predetermined determination vale (which may be referred to as a determination value α), it is determined that an abnormal temperature occurs, and the mode of the control IC 70 can be shifted from the normal mode A1 to the abnormal temperature detection mode A2.

This makes it possible to promptly detect a temperature change in the occurrence of the abnormal temperature and to reliably prevent the USB cable 10, the power source 26, the secondary cell 28 and the like from being damaged.

Here, a temperature range indicated by an arrow $T_W$ in FIG. 12 shows an operating temperature of a product (ambient operating temperature). When the USB cable 10 is in the abnormal temperature detection mode A2 and the VBUS line 12*a* is interrupted in the range of the ambient operating temperature, usability of the USB cable 10 decreases. In addition, because the ambient operating temperature is relatively low, even if the USB cable 10 is used in the temperature range, the USB cable 10, the power source 26, the secondary cell 28 and the like are unlikely to be damaged.

Therefore, in order to improve the usability while maintaining safety of the USB cable 10 and the like, the temperature change rate detection circuit may be configured not to perform the abnormal temperature detection in the range of the ambient operating temperature.

Subsequently, a description is given below of a temperature change rate detection process performed by the temperature change rate detection circuit with reference to FIG. 11.

When the temperature change rate detection circuit starts its operation, to begin with, in step S10 (step is abbreviated to "S" in FIG. 11), the temperature change rate detection circuit reads a temperature measurement value T1 measured by the temperature sensor, and stores the read temperature measurement value T1 in a storage unit such as a memory. After that, in step S12, the temperature change rate detection circuit awaits a lapse of a predetermined time (unit time Δt).

After the lapse of the predetermined time (unit time Δt), in step S14, the temperature change rate detection circuit reads the temperature measurement value T2 measured by the temperature sensor again, and stores the read temperature measurement value T1 in the storage unit such as the memory. Next, in step S16, the temperature change rate detection circuit calculates an amount of temperature change ΔT (ΔT=T2−T1) per unit time Δt.

In step S18, it is determined whether the amount of temperature change ΔT calculated in step S16 is equal to or higher than the predetermined determination value α. Here, the determination value α is set at the lowest amount of the temperature change among an amount of temperature change that occurs per unit time when a foreign substance intrudes into the μB-type plug 16. The determination value α can be obtained by performing an experiment and the like.

In step S18, when the amount of temperature change ΔT is determined to be lower than the determination value α, the temperature measurement value T2 is replaced by the temperature measurement value T1 (T2→T1), and then the process returns to step S12.

On the other hand, in step S18, when the amount of temperature change ΔT is determined to be equal to or higher than the determination value α, the process advances to step S20, it is determined whether both of the temperature measurement values T1 and T2 exceed the ambient operating temperature $T_w$, indicated by the arrow TW in FIG. 12.

When both of the temperature measurement values T1 and T2 are in the range of the ambient operating temperature $T_w$, the temperature measurement value T2 is replaced by the temperature measurement value T1 (T2→T1) in step S24, and the process returns to step S12.

In contrast, in step S20, when both of the temperature measurement values T1 and T2 are determined to exceed the ambient operating temperature $T_W$, the temperature change rate detection circuit determines that an abnormal temperature occurs in step S22, and sends an abnormal temperature detection signal to the NOR gate 81 (see FIG. 4). By causing the temperature change rate detection circuit to perform the above processes, the abnormal temperature can be promptly detected.

As discussed above, although the process in step S20 is not necessary, when considering the usability of the USB cable 10, including the process of step S20 is effective and advantageous.

Figure 13:
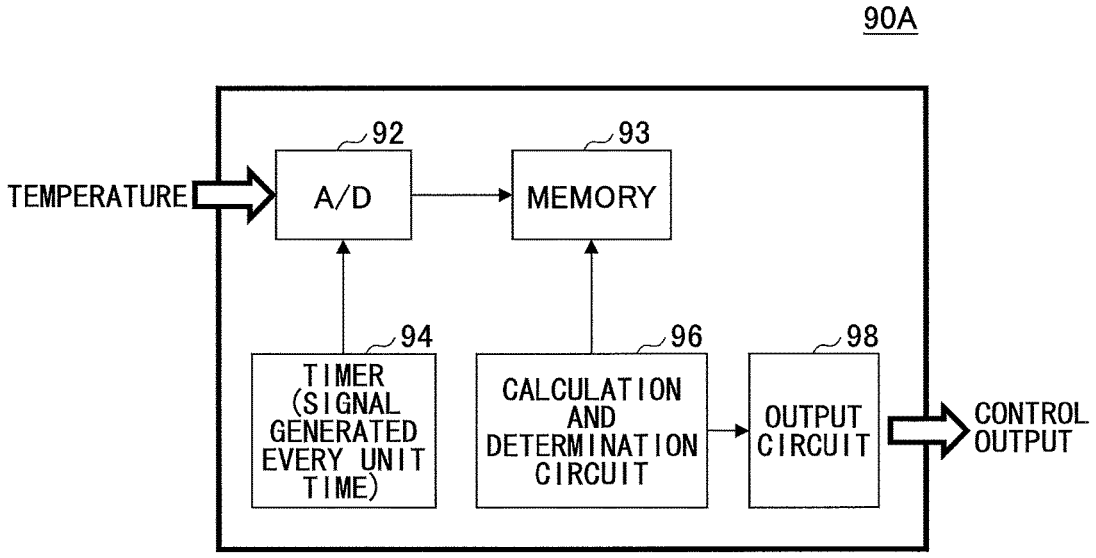
FIG. 13 is a circuit diagram illustrating an example of an abnormal temperature detection circuit.
Figure 14:
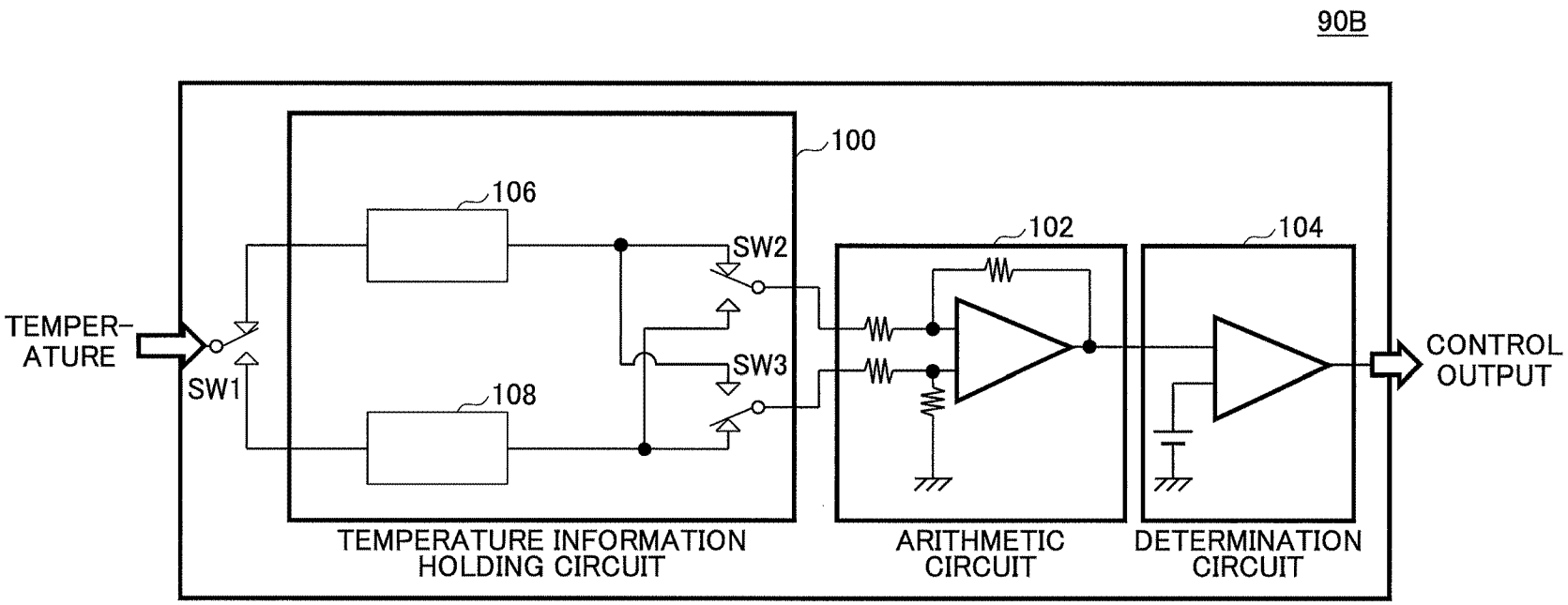
FIG. 14 is a circuit diagram illustrating another example of the abnormal temperature detection circuit.

FIGS. 13 and 14 illustrate specific examples of temperature change rate detection circuit 90A and 90B.

The temperature change rate detection circuit 90A illustrated in FIG. 13 includes an A/D converter 92, a memory 93, a timer 94, a calculation and determination circuit 96, and an output circuit 98.

A temperature signal from a temperature sensor is provided for the A/D converter 92. The timer 94 is connected to the A/D converter 92, and the A/D converter 92 converts the temperature signal from an analog signal to a digital signal and sends the digital temperature signal to the memory 93 by a trigger signal generated by the timer 94 in unit time Δt.

The calculation and determination circuit 96 acquires an amount of temperature change ΔT (ΔT=T2−T1) by subtracting the temperature measurement value T1 measured the last time from the temperature measurement value T2 measured this time stored in the memory 93. After calculating the amount of temperature change ΔT, the calculation and determination circuit 96 compares the amount of temperature change ΔT with the determination value α preliminarily stored in the memory 93. Then, when determining that the amount of temperature change ΔT is equal to or higher than the determination value α, the calculation and determination circuit 96 sends a determination signal to the output circuit 98 and then the output circuit 98 outputs an abnormal temperature detection signal to the NOR gate 81.

In contrast, the temperature change rate detection circuit 90B illustrated in FIG. 14 includes a switches SW1 through SW3, a temperature information holding circuit 100, an arithmetic circuit 102 and a determination circuit 104.

The switch SW1 and the switches SW2 and SW3 are configured to change their connection status in synchronization with each other. In the embodiment, the switches SW1 through SW3 are configured to change its connection status in unit time Δt.

The temperature information holding circuit 100 is configured to include a first voltage holding circuit 106 and a second voltage holding circuit 108 arranged in parallel with each other. The first and second temperature information holding circuit 100 and 108 are sample-and-hold circuits constituted of an operational amplifier, a capacitor and the like, and are configured to be able to hold a temperature signal provided from a temperature sensor.

The temperature signal receiving from the temperature sensor is alternately provided for the first voltage holding circuit 106 and the second voltage holding circuit 108 in unit time Δt by the switch SW1. Thus, the first voltage holding circuit 106 and the second voltage holding circuit 108 hold the temperature signal whose measurement time is shifted in unit time from each other.

The arithmetic circuit 102 receives the temperature measurement values T1 and T2 whose measurement time is shifted in unit time from each other from the first and second voltage holding circuits 106 and 108 alternately by switching the switches SW2 and SW3 in unit time Δt.

The arithmetic circuit 102 acquires an amount of temperature change ΔT (ΔT=T2−T1) by subtracting the temperature measurement value T1 from the temperature measurement value T2. Moreover, when comparing the amount of temperature change ΔT with a reference voltage corresponding to the determination value α and detecting that the amount of temperature change ΔT is equal to or higher than the determination value α, the arithmetic circuit 102 sends a determination signal to the determination circuit 104. Upon receiving the determination signal, the determination circuit 104 sends an abnormal temperature detection signal to the NOR gate 81.

Here, the temperature change rate detection circuit is not limited to the temperature change rate detection circuits 90A and 90B illustrated in FIGS. 13 and 14, but adopting a variety of circuit configuration is possible.

Next, a description is given below by focusing on an interruption direction of a current in the control circuit 11 illustrated in FIG. 4.

As the embodiment illustrated in FIG. 4, when using a semiconductor device such as the FET 60 as a part for interrupting the VBUS line 12*a* in the abnormal state, although current control is possible in only one direction due to a parasitic diode (Body-Diode) created inside the semiconductor device, the current interruption control is impossible in the reverse direction because a current flows through the parasitic diode.

In the example of FIG. 4, the interruption control is possible only in a current direction flowing from a source to a drain and in a current direction flowing from the A-type plug 14 to the μB-type plug. In other words, when the power source 26 is connected to the B-type plug 16 and the secondary cell 28 is connected to the A-type plug 14, a proper process of charging the secondary cell 28 cannot be performed.

However, the USB cable 10 is expected to be used for bidirectional power feeding more and more as its increasing intended purpose in the future. More specifically, when the A-type plug 14 is connected to a power supply unit, the power supply unit charges a secondary cell connected to the μB-type plug 16, or drives a load connected to the μB-type plug 16.

In the USB cable 10 capable of the bidirectional power feeding, when the A-type plug 14 is connected to a load, the secondary cell connected to the μB-type plug 16 can drive the load. At this time, the load may be a mobile device or a secondary cell. Furthermore, when the secondary cell is connected to the A-type plug 14 as the load, the secondary cell connected to the μB-type plug 16 can charge the secondary cell connected to the A-type plug 14.

Next, a description is given below of configurations of specific control circuits capable of the bidirectional power feeding as discussed above.

Figure 15:
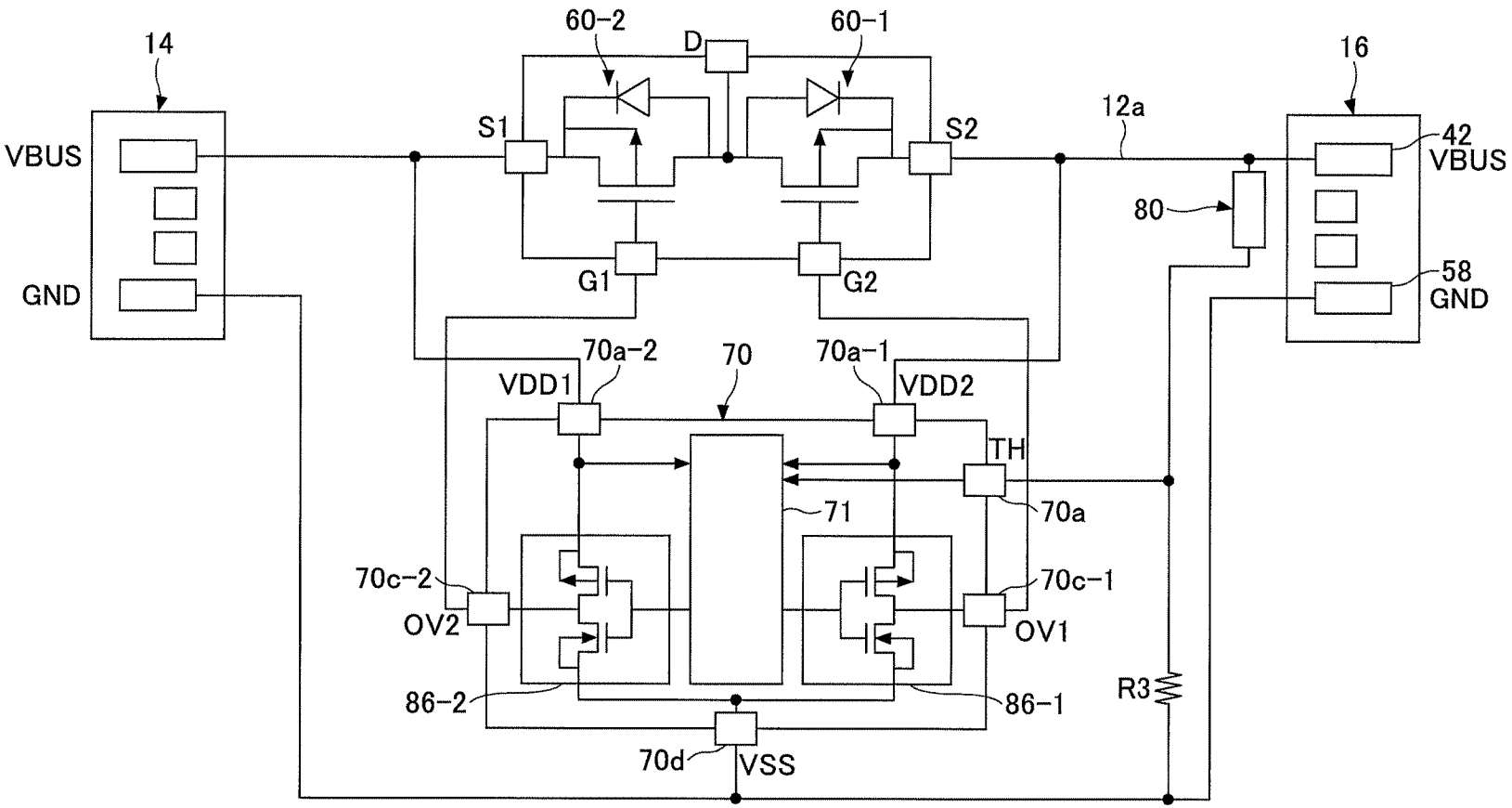
FIG. 15 is a first block diagram of a control circuit according to another embodiment of the present invention.
Figure 16:
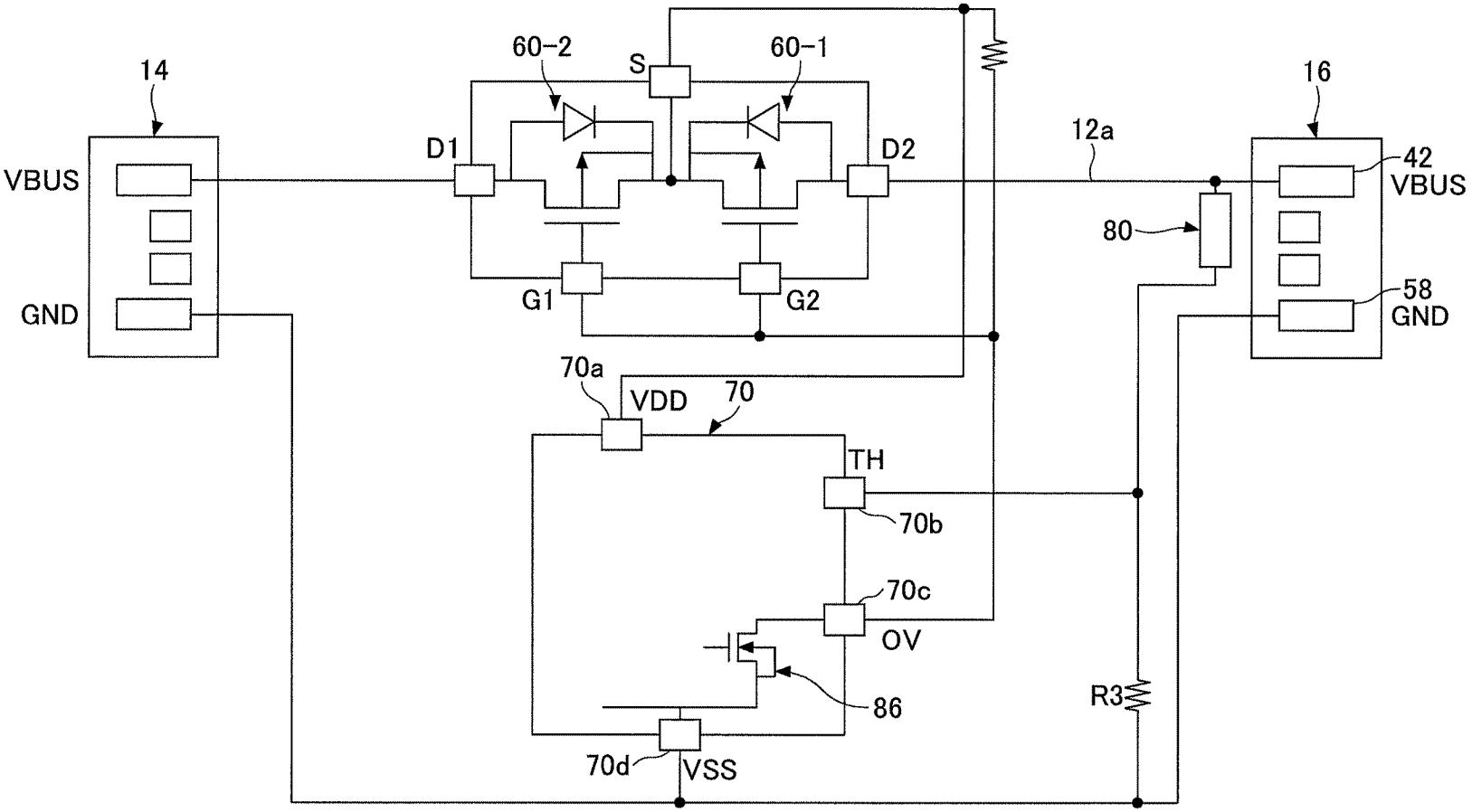
FIG. 16 is a second block diagram of a control circuit according to another embodiment of the present invention.

FIGS. 15 and 16 illustrate control circuits 111 and 211 configured to be capable of bidirectional power feeding to two directions of the USB cable 10. In FIGS. 15 and 16, the same numerals are used for components corresponding to the components illustrated in FIG. 4, and a description thereof is omitted.

In the USB cable 10 capable of the bidirectional power feeding, both of the power feeding from a power source connected with the A-type plug 14 to the μB-type plug 16 and from a power source connected with the μB-type plug 16 to the A-type plug 14 are possible. Accordingly, the current interruption control needs to handle bidirectional currents.

In an example illustrated in FIG. 15, the control circuit 111 is configured to be able to interrupt bidirectional currents by adding two FETs 60-1 and 602 in the VBUS line 12*a* in series. The FET 60-1 and the FET 60-2 are connected to the VBUS line 12*a* in series so as to share a drain thereof with each other. In the following description, a pair of bi-directionally connected FETs 60-1 and 60-2 may be referred to as a bidirectional switch.

The control IC 70 of the control circuit 111 includes a pair of interruption signal output parts 86-1 and 86-2 corresponding to the pair of FETs 60-1 and 60-2. In FIG. 15, for convenience of depiction, although only the interruption signal output parts 86-1 and 86-2 are illustrated, the temperature detection part 72, the over discharge detection part 74, the open detection part 76, the reset part 78, the NOR gate 81, the latch control part 82, and the level shift part 84 and the like are illustrated as a control circuit configuration part 71 together.

However, in the control circuit 111 illustrated in FIG. 15, voltages equal to potentials of sources S1 and S2 need to be applied to gates G1 and G2 of the FETs 60-1 and 60-2, respectively, so that the control IC 70 reliably interrupts the FETs 60-1 and 60-2, respectively. Because of this, the control IC 70 needs a VDD1 terminal 70*a*-1 and a VDD2 terminal 70*a*-2, and interruption signal output terminals (OV terminals) 70*c*-1 and 70*c*-2 for the FETs 60-1 and 60-2, respectively, thereby considerably increasing a dimension and the number of terminals of the control IC 70.

In contrast, although the control circuit 211 illustrated in FIG. 16 is configured by adding two FETs 60-1 and 60-2 in the VBUS line 12*a* in series as well as the control circuit 111 illustrated in FIG. 15, the control circuit 211 differs from the control circuit 111 in that the FETs 60-1 and 60-2 are provided in the VBUS line 12*a* in series so as to share a source thereof with each other.

As the embodiment, by connecting each of the sources of the FETs 60-1 and 60-2 as the middle point and disposing drains D1 and D2 outside, parasitic diodes of the FETs 60-1 and 60-2 can be used a wired OR.

This allows the FETs 60-1 and 60-2 to use the VDD terminal 70*a* of the control IC 70 as a common power source (VDD) even if either the A-type plug 14 or the μB-type plug 16 supplies electricity. In addition, the gate potentials of the respective FETs 60-1 and 60-2 in interrupting the currents can be made the above-mentioned wired OR (common source potential), and the FETs 60-1 and 60-2 can reliably perform the bidirectional current interruption of the VBUS line 12*a*.

As illustrated in FIGS. 15 and 16, because the control circuits 111 and 211 control the bidirectional switch (FETs 60-1 and 60-2) provided in the VBUS line 12*a* in series, the bidirectional power feeding is possible in the normal state by using the USB cable 10, and the VBUS line 12*a* can be interrupted by turning off the bidirectional switch in the occurrence of the abnormality (the case of the temperature detected by the NTC thermistor 81 exceeding the predetermined value and the like).

According to the embodiments of the present invention, an abnormal temperature can be promptly and reliably detected and troublesome work such as fuse replacement can be made unnecessary.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that the various changes, substitutions, and alterations could be made hereto without departing from the spirit and scope of the invention.

More specifically, in the embodiments, the example of disposing the NTC thermistor 80 in the vicinity of the VBUS terminal 42 is illustrated, but the temperature of the GND terminal 48 may increase depending on the intrusion location of a foreign substance. Hence, the NTC thermistor 80 may be disposed at a position close to the GND terminal 48.

Moreover, the μB-type plug 16 may be configured to include an indicator configured to inform the preservation of the interruption of the VBUS line 12*a* when the control IC 70 maintains the interruption of the VBUS line 12*a* and an indicator control circuit configured to control the indicator. For example, an LED may be used as the indicator. The LED may be lighted when maintaining the interruption of the VBUS line 12*a*, or may be extinguished when maintaining the interruption while being lighted except during the interruption. By configuring the control IC 70 in this manner, the control IC 70 can inform a user of the USB cable 10 of the abnormality of the USB cable 10.

Furthermore, in the above-discussed examples, the control circuit 11, 111, 211, the FET 60, 60-1, 60-2, and the NTC thermistor 81 are built in the housing 20 on the μB-type plug 16 side, but each of the components may be built in the housing 18 on the A-type plug 14, or may be built in both of the housings 18 and 20 of the A-type plug 14 and the μB-type plug 16, respectively. In this case, because both of the A-type plug 14 and the μB-type plug 16 can detect the abnormal temperature, reliability of the control circuit 11, 111, 211 can be enhanced.

What is claimed is:

1. A power supply cable comprising:

a plug connected to a receptacle to which a secondary cell is connected, the plug including a housing and a substrate provided in the housing;

a cable including a power supply line and a grounding line, the cable having one end connected to the plug and the other end connected to a power supply unit;

a control circuit comprising:

a switch mounted on a first surface of the substrate provided in the housing of the plug and provided in series in a power supply interconnection connected to the power supply line;

a temperature sensor mounted on the substrate and disposed in the vicinity of a power supply terminal of the plug or a grounding terminal of the plug; and the control circuit further comprising a control IC mounted on a second surface opposite to the first surface of the substrate, the control IC comprising a temperature detection circuit, over discharge detection circuit, open detection circuit, reset circuit, interruption signal output circuit, level shift circuit, latch control circuit and NOR gate configured to detect abnormality of the temperature sensor, and further configured to interrupt the power supply interconnection by turning off the switch upon determining that a value related to a temperature detected by the temperature sensor exceeds a predetermined value, and configured to interrupt the power supply interconnection by turning off the switch upon determining that the temperature sensor abnormality detection circuit detects the abnormality of the temperature sensor.

2. The power supply cable as claimed in claim 1, wherein the value related to the temperature is the temperature detected by the temperature sensor.

3. The power supply cable as claimed in claim 1, wherein the control circuit includes a temperature change rate detection circuit configured to detect a change rate per unit time of the temperature detected by the temperature sensor, and the value related to the temperature is the temperature change rate per unit time detected by the temperature change rate detection circuit.

4. The power supply cable as claimed in claim 1, wherein the control circuit is configured to interrupt the power supply interconnection by turning off the switch upon determining a voltage of the power supply interconnection is equal to or lower than a predetermined voltage.

5. The power supply cable as claimed in claim 4, wherein the control circuit includes a latch circuit configured to maintain an interruption of the power supply line until interrupting power supply from the power supply unit or until determining that the power supply from the power supply unit is stopped.

6. The power supply cable as claimed in claim 5, further comprising:

an indicator configured to notify a user of preservation of the interruption of the power supply interconnection upon determining that the latch circuit maintains the interruption of the power supply interconnection; and an indicator control circuit configured to control the indicator.

7. The power supply cable as claimed in claim 1, wherein the switch is mounted on the substrate and provided in series in a grounding interconnection connected to the grounding line.

8. The power supply cable as claimed in claim 1, wherein the switch is a bidirectional switch.

9. A control circuit used with a power supply cable, the power supply cable including:

a plug connected to a receptacle to which a secondary cell is connected, the plug including a housing and a substrate provided in the housing; and a cable including a power supply line and a grounding line, the cable having one end connected to the plug and the other end connected to a power supply unit, the control circuit comprising:

a switch mounted on a first surface of the substrate provided in the housing of the plug and provided in series in a power supply interconnection connected to the power supply line;

a temperature sensor mounted on the substrate and disposed in the vicinity of a power supply terminal of the plug or a grounding terminal of the plug; and the control circuit further comprising a control IC mounted on a second surface opposite to the first surface of the substrate, the control IC comprising a temperature detection circuit, over discharge detection circuit, open detection circuit, reset circuit, interruption signal output circuit, level shift circuit, latch control circuit and NOR gate configured to detect abnormality of the temperature sensor, and further configured to interrupt the power supply interconnection by turning off the switch upon determining that a value related to a temperature detected by the temperature sensor exceeds a predetermined value, and configured to interrupt the power supply interconnection by turning off the switch upon determining that the temperature sensor abnormality detection circuit detects the abnormality of the temperature sensor.

10. The control circuit as claimed in claim 9, wherein the value related to the temperature is the temperature detected by the temperature sensor.

11. The control circuit as claimed in claim 9, further comprising:

a temperature change rate detection circuit configured to detect a change rate per unit time of the temperature detected by the temperature sensor, and the value related to the temperature is the temperature change rate per unit time detected by the temperature change rate detection circuit.

12. The control circuit as claimed in claim 9, wherein the control integrated circuit is configured to interrupt the power supply interconnection by turning off the switch upon determining a voltage of the power supply interconnection is equal to or lower than a predetermined voltage.

13. The control circuit as claimed in claim 12, further comprising:

a latch circuit configured to maintain an interruption of the power supply line until interrupting power supply from the power supply unit or until determining that the power supply from the power supply unit is stopped.

14. The control circuit as claimed in claim 13, further comprising:

an indicator configured to notify a user of preservation of the interruption of the power supply interconnection upon determining that the latch circuit maintains the interruption of the power supply interconnection; and an indicator control circuit configured to control the indicator.

15. The control circuit as claimed in claim 9, wherein the switch is mounted on the substrate and provided in series in a grounding interconnection connected to the grounding line.

16. The control circuit as claimed in claim 9, wherein the switch is a bidirectional switch.

17. A substrate provided in a housing of a power supply cable, the power supply cable including:

a plug connected to a receptacle to which a secondary cell is connected; and a cable including a power supply line and a grounding line, the cable having one end connected to the plug and the other end connected to a power supply unit, the substrate comprising:

a switch mounted on a first surface of the substrate provided in series in a power supply interconnection connected to the power supply line;

a temperature sensor disposed in the vicinity of a power supply terminal of the plug or a grounding terminal of the plug;

and a control IC mounted on a second surface opposite to the first surface of the substrate, the control IC comprising a temperature detection circuit, over discharge detection circuit, open detection circuit, reset circuit, interruption signal output circuit, level shift circuit, latch control circuit and NOR gate configured to detect abnormality of the temperature sensor, and further configured to interrupt the power supply interconnection by turning off the switch upon determining that a value related to a temperature detected by the temperature sensor exceeds a predetermined value, and configured to interrupt the power supply interconnection by turning off the switch upon determining that the temperature sensor abnormality detection circuit detects the abnormality of the temperature sensor.

18. The substrate as claimed in claim 17, wherein the value related to the temperature is the temperature detected by the temperature sensor.

19. The substrate as claimed in claim 17, wherein the switch is a bidirectional switch.

20. The power supply cable as claimed in claim 1, wherein the temperature sensor abnormality detection circuit detects an open fault of the temperature sensor.

* * * * *